US011298706B2

(12) United States Patent
Damak et al.

(10) Patent No.: US 11,298,706 B2
(45) Date of Patent: Apr. 12, 2022

(54) SYSTEMS AND METHODS FOR COLLECTING FLUID FROM A GAS STREAM

(71) Applicant: Infinite Cooling Inc., Somerville, MA (US)

(72) Inventors: Maher Damak, Cambridge, MA (US); Karim Khalil, Boston, MA (US); Kripa Varanasi, Lexington, MA (US)

(73) Assignee: Infinite Cooling Inc., Somerville, MA (US)

( * ) Notice: Subject to any disclaimer, the term of this patent is extended or adjusted under 35 U.S.C. 154(b) by 0 days.

(21) Appl. No.: 16/917,700

(22) Filed: Jun. 30, 2020

(65) Prior Publication Data

US 2021/0031212 A1 Feb. 4, 2021

Related U.S. Application Data

(60) Provisional application No. 62/881,814, filed on Aug. 1, 2019.

(51) Int. Cl.
*B03C 3/09* (2006.01)
*B03C 3/38* (2006.01)
(Continued)

(52) U.S. Cl.
CPC ..... *B03C 3/09* (2013.01); *B03C 3/38* (2013.01); *B03C 3/41* (2013.01); *B03C 3/47* (2013.01); *B03C 3/88* (2013.01); *F28C 1/003* (2013.01)

(58) Field of Classification Search
CPC combination set(s) only.
See application file for complete search history.

(56) References Cited

U.S. PATENT DOCUMENTS 1,343,482 A 6/1920 August et al.
2,588,111 A 3/1952 Hanneman
(Continued)

FOREIGN PATENT DOCUMENTS

CN 205341043 U 6/2016
CN 106423564 A 2/2017
(Continued)

OTHER PUBLICATIONS

Aqualonis; https://www.aqualonis.com/ (Year: 2015).*
(Continued)

*Primary Examiner* — Christopher P Jones
*Assistant Examiner* — Sonji Turner
(74) *Attorney, Agent, or Firm* — Choate, Hall & Stewart LLP; Kristen C. Buteau; Michael D. Schmitt

(57) ABSTRACT

An example of a system for use in collecting fluid from a gas stream includes one or more collection panels and a frame for arranging the panel(s). Each of the collection panel(s) may comprise an emitter electrode assembly member, comprising one or more emitter electrodes, physically attached to an electrically insulated from a fluid collection member comprising one or more collection electrodes. The frame may be sized and shaped to be disposed near a gas outlet or a duct. An example of a method for collecting fluid from a gas stream includes providing the collection panel(s) disposed in a path of the gas stream; providing the gas stream; generating and maintaining a voltage at the one or more emitter electrodes of each of the collection panel(s); and collecting an amount of the fluid from the gas stream with the one or more collection panels.

26 Claims, 14 Drawing Sheets
(2 of 14 Drawing Sheet(s) Filed in Color)

(51) Int. Cl.

| | |
|---|---|
| ***B03C 3/47*** | (2006.01) |
| ***B03C 3/88*** | (2006.01) |
| ***B03C 3/41*** | (2006.01) |
| ***F28C 1/00*** | (2006.01) |

(56) References Cited

U.S. PATENT DOCUMENTS

| | | | | |
|---|---|---|---|---|
| 2,708,488 | A | 5/1955 | Gustaf | |
| 2,987,137 | A | 6/1961 | Brixius et al. | |
| 3,040,497 | A * | 6/1962 | Schwab | B03C 3/66 96/32 |
| 3,600,653 | A * | 8/1971 | Hall | B03C 9/00 95/62 |
| 3,816,980 | A * | 6/1974 | Schwab | B03C 3/66 96/54 |
| 3,851,702 | A * | 12/1974 | Heller | F28B 1/06 165/110 |
| 3,923,935 | A * | 12/1975 | Cates | F28C 1/14 261/159 |
| 3,934,817 | A | 1/1976 | Barry et al. | |
| 3,972,701 | A | 8/1976 | Teel | |
| 4,098,854 | A * | 7/1978 | Knirsch | F28C 1/14 261/161 |
| 4,102,038 | A | 7/1978 | Eagan | |
| 4,104,696 | A | 8/1978 | Cochran, Jr. | |
| 4,133,653 | A * | 1/1979 | Soltis | B03C 3/40 96/58 |
| 4,233,037 | A | 11/1980 | Pontius et al. | |
| 4,249,391 | A | 2/1981 | Taylor | |
| 4,273,146 | A | 6/1981 | Johnson | |
| 4,279,625 | A * | 7/1981 | Inculet | F27D 17/004 110/216 |
| 4,360,366 | A * | 11/1982 | Collins | B03C 3/16 96/45 |
| 4,362,538 | A | 12/1982 | Cox et al. | |
| 4,502,872 | A | 3/1985 | Ivester et al. | |
| 4,514,344 | A * | 4/1985 | Ruscheweyh | B01F 5/0473 261/109 |
| 4,514,750 | A | 4/1985 | Adams | |
| 4,662,902 | A * | 5/1987 | Meyer-Pittroff | C02F 1/16 261/160 |
| 4,670,026 | A | 6/1987 | Hoenig | |
| 4,700,014 | A | 10/1987 | Joy et al. | |
| 4,715,870 | A * | 12/1987 | Masuda | B03C 3/155 96/67 |
| 5,264,014 | A * | 11/1993 | Lannefors | B05B 14/42 96/44 |
| 5,275,643 | A | 1/1994 | Usui | |
| 5,407,171 | A * | 4/1995 | Gonzalez | F16M 5/00 248/670 |
| 5,449,036 | A * | 9/1995 | Genge | F28D 5/02 165/104.19 |
| 6,096,119 | A * | 8/2000 | Ho | B03C 3/12 96/21 |
| 6,152,378 | A | 11/2000 | Alekseevich et al. | |
| 6,156,104 | A * | 12/2000 | Jeong | B03C 3/70 96/88 |
| 6,302,944 | B1 | 10/2001 | Hoenig | |
| 6,576,046 | B2 * | 6/2003 | Pruette | B03C 3/025 96/100 |
| 6,679,940 | B1 * | 1/2004 | Oda | A61L 9/22 96/55 |
| 6,872,238 | B1 | 3/2005 | Truce | |
| 7,090,717 | B2 | 8/2006 | Kim et al. | |
| 7,485,174 | B2 | 2/2009 | Wang | |
| 7,540,903 | B2 | 6/2009 | Ladrech et al. | |
| 7,833,323 | B2 | 11/2010 | Takayanagi et al. | |
| 8,337,600 | B2 | 12/2012 | Paur et al. | |
| 8,425,657 | B2 | 4/2013 | Ursem et al. | |
| 8,814,995 | B2 | 8/2014 | Johansson et al. | |
| 9,073,079 | B2 * | 7/2015 | Schulze | B03C 3/09 |
| 9,308,537 | B2 | 4/2016 | Krichtafovitch | |
| 9,610,587 | B2 | 4/2017 | Roux | |
| 9,789,494 | B2 * | 10/2017 | Wiser, III | B03C 3/64 |
| 11,123,751 | B2 | 9/2021 | Damak et al. | |
| 11,123,752 | B1 | 9/2021 | Damak et al. | |
| 2002/0134665 | A1 | 9/2002 | Taylor et al. | |
| 2005/0152818 | A1 | 7/2005 | Botvinnik et al. | |
| 2006/0130658 | A1 * | 6/2006 | Chang | B03C 3/09 96/77 |
| 2007/0063361 | A1 | 3/2007 | Palmer | |
| 2009/0235821 | A1 | 9/2009 | Mochizuki et al. | |
| 2010/0037776 | A1 | 2/2010 | Chan | |
| 2011/0203459 | A1 * | 8/2011 | Swoboda | B03C 3/47 96/62 |
| 2011/0227236 | A1 * | 9/2011 | Vouche | F28C 1/00 261/128 |
| 2012/0180512 | A1 | 7/2012 | Laing et al. | |
| 2013/0047857 | A1 | 2/2013 | Bohlen | |
| 2013/0228941 | A1 * | 9/2013 | Bogh | E04H 5/12 261/159 |
| 2013/0233365 | A1 | 9/2013 | Loos | |
| 2014/0260987 | A1 * | 9/2014 | Park | F28C 1/16 96/53 |
| 2015/0290352 | A1 * | 10/2015 | Ota | F24F 3/1603 422/121 |
| 2015/0343454 | A1 | 12/2015 | Tyburk | |
| 2015/0360235 | A1 | 12/2015 | Ueda et al. | |
| 2015/0375237 | A1 * | 12/2015 | Kojima | B03C 3/41 95/57 |
| 2017/0354979 | A1 | 12/2017 | Krichtafovitch | |
| 2018/0078950 | A1 | 3/2018 | Sato et al. | |
| 2018/0178222 | A1 | 6/2018 | Tolvanen | |
| 2018/0272358 | A1 * | 9/2018 | Damak | B03C 3/08 |
| 2019/0039077 | A1 | 2/2019 | Jeon et al. | |
| 2019/0351431 | A1 | 11/2019 | Krichtafovitch | |
| 2020/0353480 | A1 * | 11/2020 | Lee | B03C 3/78 |
| 2020/0360935 | A1 * | 11/2020 | Lee | B03C 3/78 |
| 2020/0368757 | A1 * | 11/2020 | Lee | C02F 1/28 |
| 2020/0368760 | A1 * | 11/2020 | Lee | B03C 3/82 |
| 2021/0031213 | A1 | 2/2021 | Damak et al. | |
| 2021/0268517 | A1 | 9/2021 | Damak et al. | |

FOREIGN PATENT DOCUMENTS

| | | | | |
|---|---|---|---|---|
| CN | 109261360 | A * | 1/2019 | |
| DE | 102007061199 | A1 | 6/2009 | |
| EP | 0009857 | A2 | 4/1980 | |
| JP | 08049989 | A * | 2/1996 | |
| KR | 101460663 | B1 * | 11/2014 | B03C 3/16 |
| RU | 2494326 | C1 | 9/2013 | |
| RU | 2503501 | C1 | 1/2014 | |
| WO | WO-98/57750 | A1 | 12/1998 | |
| WO | WO-2012/072829 | A1 | 6/2012 | |
| WO | WO-2017/058949 | A1 | 4/2017 | |
| WO | WO-2020/092779 | A1 | 5/2020 | |
| WO | WO-2021/021369 | A1 | 2/2021 | |
| WO | WO-2021/021370 | A1 | 2/2021 | |
| WO | WO-2021/173178 | A1 | 9/2021 | |

OTHER PUBLICATIONS

Chrzan, K. L. and Streubel, H., Artificial Rain Test of Outdoor Long Rod Insulatators, Proceedings of the 16th International Symposium on High Voltage Engineering, ISBN:978-0-620-44584-9, Paper E-31:1-5, (2009).

Daal, L. et al., Evaluation of different water vapor capture technologies and energy modeling results for membrane technology, Icapwa, DNV-KEMA the Netherlands, Department PGR-PCW, P.O. Box 9035, 6800 ET Arnhem, The Netherlands, Combined Paper ID: 186 & 192, 21 pages, (2012).

Kraemer, H. and Johnstone, H.F., Collection of Aerosol Particles in Presence of Electrostatic Fields, Industrial and Engineering Chemistry, 47(12):2426-2434 (1955).

Levy, E. et al., Recovery of Water From Boiler Flue Gas—Final Technical Report, 97 pages (issued Dec. 2008).

Lindahl, P. et al., Plume Abatement—The Next Generation, Cooling Technology Institute, Presented at the 2010 Cooling Technology Institute Annual Conference, 10 pages (Feb. 7-11, 2010).

(56) References Cited

OTHER PUBLICATIONS

Tyagi, S.K. et al., Formation, potential and abatement of plume from wet cooling towers: A review, Renewable and Sustainable Energy Reviews, 16:3409-3429 (2012).
Uchiyama, H. and Jyumonji, M., Field experiments of an electrostatic fog-liquefier, Journal of Electrostatics, 35:133-143 (1995).
International Search Report for PCT/US2020/040352 (Systems, Devices, and Methods for Collecting Species From a Gas Stream, filed Jun. 30, 2020) received by ISA/EP, 7 pages (dated Jan. 11, 2021).
Written Opinion for PCT/US2020/040352 (Systems, Devices, and Methods for Collecting Species From a Gas Stream, filed Jun. 30, 2020) received by ISA/EP, 19 pages (dated Jan. 11, 2021).
International Search Report for PCT/US2020/040346 (Systems and Methods for Collecting Fluid From a Gas Stream, filed Jun. 30, 2020) received from ISA/EP, 5 pages (Oct. 14, 2020).
Uchiyama, H. and Jyumonji, M., Development of an Electrostatic Fogliquefier and its Field Experiments, Japanese Journal of Applied Physics, Japan Society of Applied Physics, 28(11): the whole document (1989).
Written Opinion for PCT/US2020/040346 (Systems and Methods for Collecting Fluid From a Gas Stream, filed Jun. 30, 2020) received from ISA/EP, 14 pages (dated Oct. 14, 2020).

* cited by examiner

SYSTEMS AND METHODS FOR COLLECTING FLUID FROM A GAS STREAM

PRIORITY APPLICATION

This application claims the benefit of U.S. Provisional Patent Application No. 62/881,814, filed on Aug. 1, 2019, the disclosure of which is hereby incorporated by reference herein in its entirety.

TECHNICAL FIELD

This disclosure relates generally to systems and methods for collecting fluid from a gas stream. In some embodiments, water is collected from air escaping a cooling tower.

BACKGROUND

Cooling towers are heat rejection systems that are used to cool a stream of water to a desired temperature. Wet cooling towers use evaporative cooling where heat transfer takes place both through sensible heat of air and evaporation latent heat. Cooling towers use large quantities of water because they have to make up for the water losses they incur. Evaporation is the main water loss: once water is converted into vapor to reject heat, the generated vapor is released into the ambient air where it is permanently lost.

When vapor leaves the tower, it may, under certain ambient conditions, condense as it leaves the cooling tower and form a plume of fog. This usually happens when the ambient air is cold and/or humid. Regulatory requirements relating to safety (drifting plumes can reduce visibility on roads and airports) and aesthetics, force some cooling towers to be equipped with plume abatement systems, which generally heat the exiting vapor and decrease its moisture content, either by heat exchangers or by blowing hot dry air and mixing it with the exiting vapor, thereby preventing the formation of fog droplets at the outlet of the tower. These abatement systems are able to remove the appearance of the plume, however the plant consumes the same amount of water, and lowers its overall net energy efficiency due to the added heat it has to create or redirect to the cooling tower outlets.

Several plume abatement systems have been developed to reduce fogging at the outlet of a cooling tower. One design relies on adding heat sources to the saturated air leaving the tower. By placing heat exchangers at the "wet section" of the tower, i.e., the part where air is saturated, the air is heated without any increase in the moisture content. This leads to a decrease in the relative humidity of the exiting air, which is not saturated anymore, and diminishes the probability of plume formation when air exists the tower. Another design relies on heating the air in a "dry section" and mixing it with the saturated exiting air. It also relies on heat exchangers, which heat some of the ambient air. The air is then drawn though fans to the wet section of the tower, mixed with the moist air, and the exiting mixture then has a lower relative humidity and is therefore less prone to fogging. A third design consists of adding a condensation module, which is a heat exchanger that cools down the exiting moist air, making some of it condense on the surface of the heat exchanger, thereby reducing the moisture content in the air. The air leaving the tower after the condenser module has then less relative humidity and it is less likely to form fog as it contacts the ambient air. All three of these designs require considerable additional investment in equipment and energy for a cooling tower, and some of them (in particular the first two designs above) do not result in any water recovery.

In addition to plume elimination, water losses are an important problem for cooling towers, and some devices have been designed to collect the exiting vapor from cooling towers to reuse it again in the cycle. One method to capture vapor is through liquid sorption. Using a liquid desiccant that is put into contact with the exiting moist air, vapor sorption in the desiccant occurs and the water is recovered and stored in the desiccant. This method can capture a significant part of the exiting vapor. However, significant energy has to be provided to then extract the collected liquid from the desiccant. Another method is through solid sorption, using solid desiccants. This method is similar to the previous one, except that it uses a solid as a desiccant. It can generally achieve very low moisture contents and is more costly. A third method is condensation through cooling. It consists in using heat exchangers in the wet section of the tower to cool the air and condense part of it. The condensate is then captured and can be reused. Such a setup is costly in equipment and, depending on the way the cooling is done, may be costly in energy as well.

SUMMARY

The present disclosure describes, inter alia, systems for collecting fluid from a gas stream and methods of their use. Examples of applications where fluid may be collected from a gas stream include cooling towers, chimneys, steam vents, steam exhausts, HVAC systems, and combustion exhausts. Systems described herein can be used to collect fluid near an outlet for a gas stream (e.g., an outlet of a cooling tower) or in the middle of a gas stream (e.g., somewhere along a duct of exhaust or other HVAC system). In certain embodiments, using a discharge electrode, ion injection is used to charge droplets in a gas stream and attract them to a collecting electrode with an electric field. Systems described herein may be used for plume abatement while also collecting fluid (e.g., water) for later reuse (if desired). In some embodiments, plume abatement can occur at much lower cost than conventional systems, at least in part because energy requirements for operation may be much lower than in conventional systems.

A system may include one or more collection panels (e.g., modular collection panels) that each include one or more emitter electrodes and one or more collection electrodes that are spaced in proximity to each other in order to collect fluid from gas stream that passes through the panel(s). The one or more panels may be attached to a frame that holds them in a desirable position, for example to maximize fluid collection. The frame may also be used, for example, to allow the panel(s) to be repositioned at certain times or under certain conditions. For example, in some embodiments, panels installed at a cooling tower are moveable between an open and a closed state so that they can in the opened state when maximum cooling is needed and in the closed state when collecting fluid.

The present disclosure describes systems and methods that can be used in a cooling tower. In some embodiments, systems and methods disclosed herein deliberately make use of natural, spontaneous fog formation near an outlet of a cooling tower to collect the formed water droplets from escaping air with one or more electric collection panels at the outside of the tower. The collected water can be used as make-up water for the cooling tower, therefore considerably reducing the water consumption of cooling towers. Moreover, the energy spent generating appropriate voltages at the collection panels can be significantly less than in other conventional systems, like heat exchangers that heat or cool the escaping air, while simultaneously achieving significantly higher plume abatement. Previous designs for cooling towers using condensation to capture water have been focused on condensation inside the tower, in the wet section, any escaping vapor traditionally thought of as being definitely lost. By capturing the water outside the systems and methods described herein eliminate the need for any condensation equipment and energy, as the ambient outside air fulfilling this function naturally.

In some embodiments, systems can abate at least 90% (and up to 100%) of plume formation measured on far side (relative to gas flow) of a gas outlet, thus serving the function of a plume abatement system, while also collecting a significant portion of the fluid in the passing gas stream. When installed, the passing fluid may otherwise be lost to the atmosphere and may instead be reused in a cooling cycle. For example, collected water may be reused in a cooling cycle at a cooling tower. By recirculating condensed fluid in a cooling cycle, fluid consumption in make-up fluid for a cooling tower can be highly decreased. Moreover, in the case of use in a cooling tower, since captured fluid (e.g., water) is pure, treatment and blowdown needs in the tower are reduced. Fluid may be reused for other purposes as well. Without wishing to be bound by any theory, the collected fluid is generally of high purity, which may expand the range of possible reuses. For example, in some embodiments, an amount of a fluid collected using a system disclosed herein may have a purity that is at least 5× and no more than 50× higher than a purity of the fluid before the fluid entered a gas stream (e.g., when the fluid was in use in a cooling tower).

An example of a system for use in collecting fluid from a gas stream includes one or more collection panels (e.g., one or more modular collection panels). Each of the one or more collection panels may comprise an emitter electrode assembly member comprising one or more emitter electrodes. The one or more emitter electrodes may include one or more needles and/or one or more wires. Each of the one or more collection panels may further include a fluid collection member comprising one or more collection electrodes. The one or more collection electrodes may be an electrically conductive collection surface, such as a mesh or porous surface that may be made out of, for example, metal. The fluid collection member may be physically attached to and electrically insulated from the emitter electrode assembly member. The fluid collection member may be and disposed near (e.g., within 0.5 m of, within 0.25 m of, within 0.15 m of, or within 0.1 m of) the emitter electrode assembly member. The system may further include a frame comprising one or more panel connection points for each of the one or more collection panels. The one or more collection panels may be attached to the frame by the one or more panel connection points. The frame may be sized and shaped to be disposed near (e.g., on or in) (e.g., within 25 m or within 10 m of) a gas outlet (e.g., an air outlet) (e.g., of a cooling tower) or a duct (e.g., of an HVAC system). Each of the one or more collection panels may be a flat panel, for example having a triangular or rectangular shape. The fluid may be, for example, water, seawater or brackish water. The one or more collection panels may be disposed on the frame to span a path of the gas stream.

In some embodiments, the one or more collection electrodes are grounded. In some embodiments, the one or more collection panels are operable to maintain a voltage in a range of from 1 kV to 250 kV at the one or more emitter electrodes. For example, the one or more collection panels may be operable to maintain a voltage of at least 1 kV (e.g., at least 25 kV, at least 50 kV, or at least 100 kV) and, optionally, no more than 500 kV (e.g., no more than 250 kV).

In some embodiments, each of the one or more collection panels is moveable (e.g., individually moveable) between an open state and a closed state (e.g., and, optionally, one or more semi-open states therebetween). The one or more collection panels may be moveable by an actuator, for example a pneumatic actuator, a hydraulic actuator, or an electrical actuator. In some embodiments, at least one of the open state and the closed state for at least one of the one or more collection panels has a different orientation relative to a common plane than, respectively, the open state and the closed of at least one other of the one or more collection panels. In some embodiments, the closed state comprises an angled orientation (e.g., from 30 degrees to 60 degrees relative to level ground). In some embodiments, the open state comprises a vertical orientation relative to level ground. In some embodiments, the one or more connection points comprises one or more hinges, for example a hinge for each of the one or more collection panels to move (e.g., rotate) the collection panel between the closed state and the open state.

In some embodiments, the frame is disposed near (e.g., on or in) the gas outlet such that the one or more collection panels are disposed near (e.g., in) (e.g., within 8 m) a surface of maximum fluid content of gas exiting the gas outlet. For example, the surface may be a plane or a hemisphere. A surface of maximum fluid content may be determined by physical measurement during typical operating conditions, for example prior to installation of a system. The physical location and shape of a surface may depend on, for example, the geometry of an air outlet or duct, the amount of fluid dispersed in the gas stream, and ambient conditions such as temperature and pressure. The physical location or shape of a surface may change based on a change in wind velocity (e.g., direction and/or speed). A surface of maximum fluid content may be a surface of maximum water content of air exiting the gas outlet (e.g., of a cooling tower). In some embodiments, a position of the one or more collection panels is moveable. For example, the one or more collection panels may be moveable (and moved) based on changes in location of the surface of maximum fluid content. In some embodiments, the system comprises a motion stage that operable to move (e.g., collectively) the position of the one or more collection panels. For example, the motion stage may be operable to move the frame such that the position of all of the one or more collection panels moves together.

In some embodiments, the frame comprises a dome-shaped portion comprising the one or more panel connection points. In some embodiments, the frame comprises a triangle-, pyramid-, or arch-shaped portion comprising the one or more panel connection points. Each of the one or more collection panels may be mounted to the frame at an angle from 30 degrees to 60 degrees (e.g., about 45 degrees) (e.g., in a closed state if movable) relative to level ground. The frame may be sized and shaped such that when installed and the collection panel(s) attached thereto, the collection panel(s) totally cover a gas outlet such that all passing air flows through the collection panels. In some embodiments, the frame comprises a gutter for each of the one or more collection panels (e.g., a common gutter or respective gutters), the gutter disposed such that when the one or more collection panels are attached to the frame (e.g., and in a closed state), each of the one or more collection panels drain into the gutter (e.g., wherein a portion of each of the panels, e.g. a portion of an edge and/or the collection surface, is at least partially surrounded by the gutter).

In some embodiments, each of the one or more collection panels comprises a second emitter electrode assembly member comprising one or more second emitter electrodes. The fluid collection member is physically attached to and electrically insulated from the second emitter electrode assembly member. The fluid collection member may be disposed near (e.g., within 0.5 m of) the second emitter electrode assembly member. The second emitter electrode assembly member may be disposed on an opposite side of the fluid collection member from the emitter electrode assembly member such that the fluid collection member is disposed at least partially between the second emitter electrode assembly member and the emitter electrode assembly member.

In some embodiments, the fluid collection member comprises a collection frame attached to the one or more collection electrodes, the collection frame comprising an edge (e.g., a J-edge) disposed at least partially around a perimeter of the one or more collection electrodes (e.g., around a bottom portion of the perimeter) (e.g., wherein at least a portion of the edge is perforated to allow fluid to drain away from the one or more collection electrodes). In some embodiments, each of the one or more collection panels is disposed such that at least a portion of the edge is oriented at a bottom of the collection panel such that fluid drains down (e.g., through) the edge into the gutter.

In some embodiments, the system comprises a cooling mechanism (e.g., comprising one or more external heat exchangers). In some embodiments, the cooling mechanism is disposed before the one or more collection panels along a direction of gas flow in the gas stream. In some embodiments, the cooling mechanism is disposed at or on the fluid collection member of at least one of the one or more collection panels (e.g., is a common cooling mechanism or each collection panel is associated with a respective cooling mechanism) and operable to cool the fluid collection member of each of the at least one of the one or more collection panels. In some embodiments, the system comprises a humidifying mechanism (e.g., comprising one or more external heat exchangers). In some embodiments, the humidifying mechanism is disposed before the one or more collection panels along a direction of gas flow in the gas stream (e.g., disposed inside of a cooling tower).

In some embodiments, the system comprises a particle injector. In some embodiments, the particle injector is disposed to be operable to inject the particles into the gas stream before the one or more collection panels along a direction of gas flow in the gas stream (e.g., disposed inside of a cooling tower). In some embodiments, the particle injector is operable to inject charged particles (e.g., ionized particles). In some embodiments, the particle injector is operable to inject particles of different sizes (e.g., particles having a multimodal distribution of particle sizes).

In some embodiments, the system comprises, fluid conduit in fluid contact with the one or more collection panels and one or more of a cold-water return, a hot water line, a basin of a cooling tower, and a water distribution system. In some embodiments, the system comprises fluid conduit in fluid contact with the one or more collection panels and a storage tank. In some embodiments, an intermediate filter disposed in the fluid conduit between an inlet and an outlet of the fluid conduit.

In some embodiments, the collection surface has a low contact angle hysteresis when the one or more collection panels are connected to the frame (e.g., of no more than 40 degrees difference between a receding contact angle and an advancing contact angle).

In some embodiments, the system comprises one or more wind breaks (e.g., disposed around a periphery of a gas outlet, e.g., around a periphery of a system for species collection). In some embodiments, the one or more wind breaks are disposed above a gas outlet and below a top of the one or more collection panels. In some embodiments, the one or more wind breaks comprises one or more louvers (e.g., that are angled relative to ground level). In some embodiments, the one or more wind breaks comprise one or more curved structures (e.g., that are disposed concentrically to the gas outlet).

An example of a method for collecting fluid (e.g., water) from a gas stream includes providing one or more collection panels (e.g., one or more modular collection panels) disposed in a path of the gas stream (e.g., at an outlet for the gas stream); providing the gas stream, the gas stream comprising a fluid dispersed therein (e.g., an aerosolized or vaporized fluid); generating and maintaining (e.g., for a period of at least one minute) a voltage (e.g., in a range from 1 kV to 500 kV, from 1 kV to 50 kV, from 1 kV to 100 kV, from 1 kV to 25 kV, from 25 kV to 50 kV, from 5 kV to 50 kV, or from 25 kV to 75 kV) at one or more emitter electrodes of each of the one or more collection panels; and collecting an amount of the fluid (e.g., an amount of water) from the gas stream using the one or more collection panels. The one or more collection panels may be disposed to span the path of the gas stream. Each of the one or more collection panels may comprise an emitter electrode assembly member comprising one or more emitter electrodes (e.g., one or more needles and/or one or more wires) and a fluid collection member comprising one or more collection electrodes [e.g., a mesh or porous electrically conductive (e.g., metal) collection surface]. The one or more emitter electrodes may be electrically insulated from the one or more collection electrodes. The emitter electrode(s) may be electrically insulated from the collection electrode(s) by one or more electrically insulating members having a dielectric strength of at least 200 kV/cm. In some embodiments, the one or more collection electrodes are grounded. In some embodiments, the method comprises collecting at least 80% (e.g., at least 90% or at least 95%) of the fluid from the gas stream with the one or more collection panels.

In some embodiments, the method comprises generating a corona discharge; charging the amount of the fluid as (e.g., before and/or after) the amount of the fluid passes through the one or more emitter electrodes; and depositing the amount of the fluid on the one or more collection electrodes of the one or more collection panels. In some embodiments, the method comprises forming a plurality of droplets on the one or more collection electrodes of the one or more collection panels; coalescing the plurality of droplets on the one or more collection electrodes of each of the one or more collection panels; and shedding, at least in part due to gravity, the coalesced plurality of droplets into one or more gutters.

In some embodiments, the method comprises shedding the amount of the fluid from the one or more collecting panels into one or more gutters, wherein the collecting the amount of the fluid comprises collecting the amount of the fluid from the one or more gutters. The one or more gutters may comprise a common gutter for at least some of the one or more collection panels. The one or more gutters may comprise a respective guitar for each of the one or more collection panels.

In some embodiments, collecting the amount of the fluid comprises flowing the amount of the fluid into fluid conduit (e.g., through the one or more gutters). In some embodiments, collecting the amount of the fluid comprises collecting the amount of the fluid into one or more of a cold-water return, a hot water line, a basin of a cooling tower, a storage tank, and a water distribution system.

In some embodiments, providing the one or more collection panels comprises providing the one or more collection panels disposed near (e.g., on or in) (e.g., within 25 m or within 10 m of) a gas outlet. In some embodiments, the gas outlet is an air outlet of a cooling tower. In some embodiments, the method comprises providing the one or more collection panels comprises providing the one or more collection panels disposed in a surface of maximum fluid content. In some embodiments, the method comprises moving (e.g., by a motion stage) (e.g., up or down and/or in or out) the one or more collection panels to a new surface of maximum fluid content. The one or more collection panels may be moved, for example, based on a change in wind velocity (e.g., direction and/or speed).

In some embodiments, the method comprises moving the one or more collection panels from a closed state to an open state or from the open state to the closed state. The open state may comprise a vertical orientation relative to level ground. The moving of the one or more collection panels may occur, for example, based on increase in ambient temperature and/or a decrease in concentration of the fluid in the gas stream. In some embodiments, the method comprises actuating one or more actuators in order to move the one or more collection panels from the closed state to the open state or from the open state to the closed state. In some embodiments, the one or more actuators comprises one or more of a pneumatic actuator, a hydraulic actuator, and an electrical actuator. In some embodiments, the moving the one or more collection panels comprises rotating each of the one or more collection panels (e.g., on a hinge connecting the collection panel to, e.g., a frame).

In some embodiments, the providing the one or more collection panels comprises providing each of the one or more collection panels disposed at a non-parallel orientation relative to level ground. In some embodiments, the non-parallel orientation is from 30 degrees to 60 degrees relative to level ground (e.g., with one or more of the one or more collection panels being at a different orientation from one or more others of the one or more collection panels). In some embodiments, the providing the one or more collection panels comprises providing the one or more collection panels disposed in a dome arrangement (e.g., on an air outlet of a cooling tower). In some embodiments, the providing the one or more collection panels comprises providing the one or more collection panels disposed in a triangle-, arch-, or pyramid-shaped arrangement. In some embodiments, the one or more collection panels are attached to a frame and the frame is disposed near (e.g., on or in) an outlet for the gas stream or a duct.

In some embodiments, the method comprises artificially generating additional fog in the gas stream that interacts with the one or more collection panels. In some embodiments, the method comprises cooling the gas stream prior to the one or more collection panels in a direction of flow of the gas stream. In some embodiments, the method comprises cooling the one or more collection electrodes of each of the one or more collection panels. In some embodiments, the method comprises increasing humidity in the gas stream (e.g., using one or more external heat exchangers) prior to the one or more collection panels in a direction of flow of the gas stream. In some embodiments, the method comprises injecting particles into the gas stream prior to the one or more collection panels in a direction of flow of the gas stream. The particles may be charged (e.g., ionized). The particles may comprise particles of different sizes (e.g., the particles may have a multimodal distribution of particle sizes). The method may comprise filtering the amount of the fluid after the collecting the amount of the fluid.

Each of the one or more collection panels may comprise a second emitter electrode assembly member comprising one or more second emitter electrodes. The second emitter electrode assembly member may be disposed on an opposite side of the fluid collection member from the emitter electrode assembly member such that the fluid collection member is disposed at least partially between the second emitter electrode assembly member and the emitter electrode assembly member. The method may further comprise: generating and maintaining (e.g., for a period of at least one minute) a voltage (e.g., in a range from 1 kV to 250 kV, from 1 kV to 100 kV, from 1 kV to 50 kV, from 1 kV to 25 kV, from 5 kV to 50 kV, from 25 kV to 50 kV, from 25 kV to 75 kV, from 50 kV to 100 kV, or from 50 kV to 250 kV) at the one or more second emitter electrodes of each of the one or more collection panels; and collecting a second amount of the fluid (e.g., an amount of water) from the gas stream using the one or more collection panels by redirecting (e.g., against a direction of flow of the gas stream) the second amount of the fluid toward the one or more collection electrodes of the one or more collection panels.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Drawings are presented herein for illustration purposes, not for limitation. The foregoing and other objects, aspects, features, and advantages of the disclosure will become more apparent and may be better understood by referring to the following description taken in conjunction with the accompanying drawings, in which.

DETAILED DESCRIPTION OF CERTAIN EMBODIMENTS

Figure 1A:
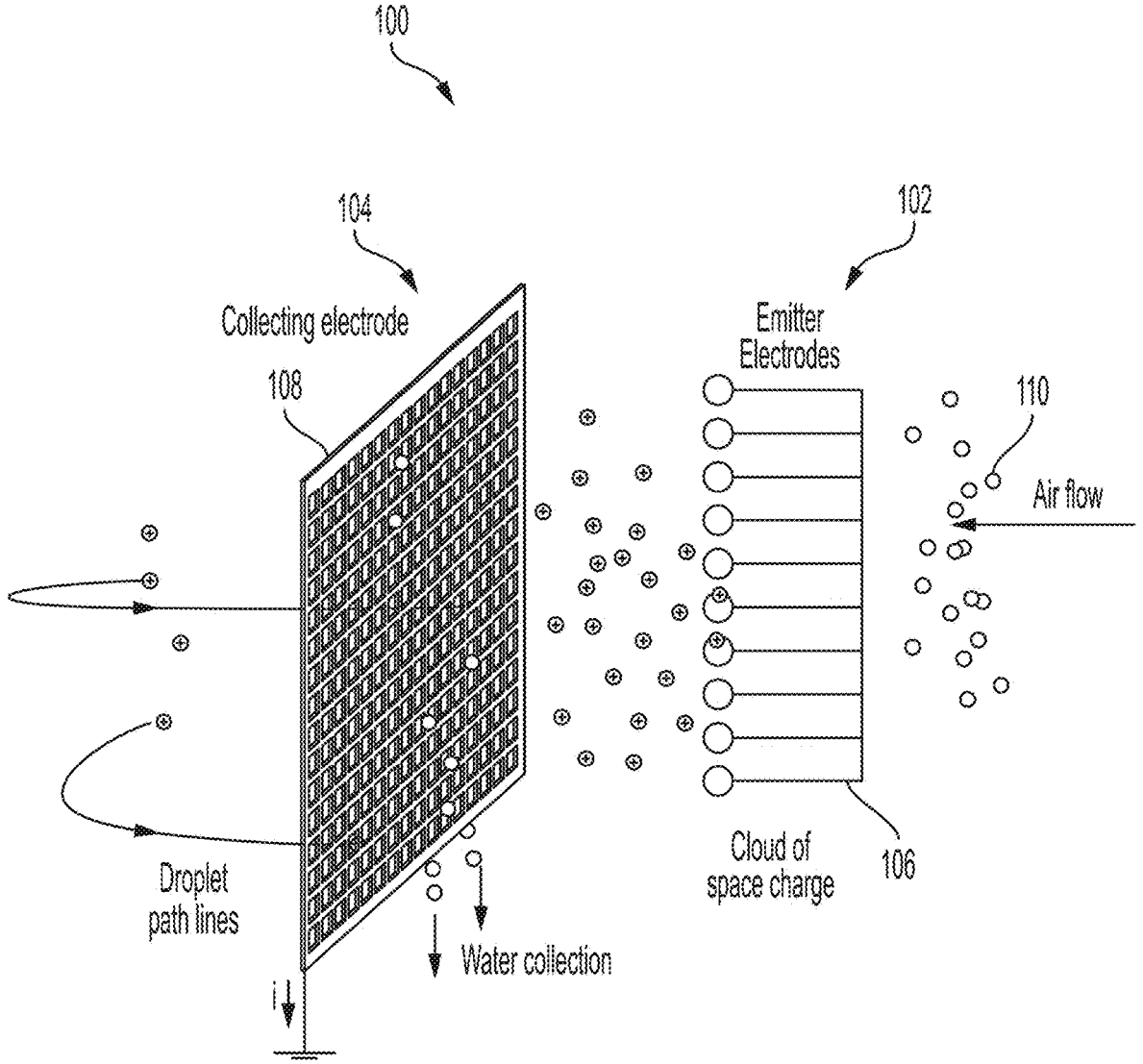
FIG. 1A is a schematic of a collection panel, according to illustrative embodiments of the present disclosure.

It is contemplated that systems, apparatus, and methods of the disclosure encompass variations and adaptations developed using information from the embodiments expressly described herein. Adaptation and/or modification of the systems, apparatus, and methods described herein may be performed by those of ordinary skill in the relevant art.

Throughout the description, where apparatus and systems are described as having, including, or comprising specific components, or where processes and methods are described as having, including, or comprising specific steps, it is contemplated that, additionally, there are articles, devices, and systems according to certain embodiments of the present disclosure that consist essentially of, or consist of, the recited components, and that there are methods according to certain embodiments of the present disclosure that consist essentially of, or consist of, the recited processing steps.

It should be understood that the order of steps or order for performing certain action is immaterial so long as operability is not lost. Moreover, two or more steps or actions may be conducted simultaneously.

In this application, unless otherwise clear from context or otherwise explicitly stated, (i) the term "a" may be understood to mean "at least one"; (ii) the term "or" may be understood to mean "and/or"; (iii) the terms "comprising" and "including" may be understood to encompass itemized components or steps whether presented by themselves or together with one or more additional components or steps; (iv) the terms "about" and "approximately" may be understood to permit standard variation as would be understood by those of ordinary skill in the relevant art; and (v) where ranges are provided, endpoints are included. In certain embodiments, the term "approximately" or "about" refers to a range of values that fall within 25%, 20%, 19%, 18%, 17%, 16%, 15%, 14%, 13%, 12%, 11%, 10%, 9%, 8%, 7%, 6%, 5%, 4%, 3%, 2%, 1%, or less in either direction (greater than or less than) of the stated reference value unless otherwise stated or otherwise evident from the context (except where such number would exceed 100% of a possible value).

Systems and method disclosed herein can be used for plume abatement and/or fluid collection (e.g., for recycling). Using systems and methods disclosed herein, plumes can form naturally first and then fluid can be collected from the plume, for example near (e.g., on or in) an outlet for a gas stream or a duct. A system may include one or more collection panels and a frame for attaching the one or more collection panels to arrange them near the outlet or duct. For example, a system may be designed to be disposed near vicinity of a cooling tower outlet.

A system may include one or more collection panels. In some embodiments, a collection panel includes an emitter electrode assembly member, including one or more emitter electrodes, physically attached to and electrically insulated from a fluid collection member comprising one or more collection electrodes. One or more emitter electrodes may include, for example, a needle (e.g., in an array of needles) or an electrically conductive wire. (A needle is an electrically conductive object with a small radius of curvature.) In some embodiments, an emitter electrode is a small radius of curvature point, such as a needle or pipe or rod with spikes. A small radius of curvature may be sufficient to generate electrical discharge (e.g., corona discharge). For example, an emitter electrode may be similar or identical to an emitter electrode used in an electrostatic precipitator, some of which use various types of small radius of curvature points to generate corona discharge. Emitter electrodes, such as needles, may be disposed, for example, perpendicular to or parallel to a collection surface or have a combination of orientations relative to the collection surface. During operation one or more emitter electrodes may be maintained at a high voltage, for example a voltage of at least 1 kV (e.g., at least 5 kV, at least 10 kV, at least 15 kV, at least 25 kV, at least 50 kV, or at least 75 kV) and, optionally, no more than 500 kV (e.g., no more than 250 kV, no more than 100 kV, or no more than 50 kV). One or more collection electrodes may be an electrically conductive (e.g., metallic) mesh or porous collection surface. The fluid collection member may be disposed near the emitter electrode assembly member, for example within 0.5 m of, within 0.25 m of, within 0.15 m of, or within 0.1 m of the emitter electrode assembly member. A collection panel may be flat panel, for example having a flat rectangular or triangular shape. Collection panels may be modular, for example such that they are removable and interchangeable if one were to fail. For example, one or more emitter electrodes in a collection panel may break and the collection panel can then be immediately interchanged with a functional panel, thereby allowing the old panel to be repaired (if desired/possible) and/or reducing down time (e.g., period of impaired functionality) of the overall system.

FIG. 1A is a schematic of a collection panel 100 with an emitter electrode assembly member 102 and a fluid collection member 104, according to illustrative embodiments of the present disclosure. In some embodiments, panel 100 includes two or more emitter electrodes 106 (as shown) in emitter electrode assembly member 102. Emitter electrodes 106 are needles in an array. In some embodiments, emitter electrodes 106 are one or more wires. During operation, emitter electrodes are maintained at a high voltage, for example at a voltage in a range from 1 kV to 500 kV (e.g., in a range from 1 kV to 100 kV or from 1 kV to 50 kV). Fluid collection member 104 includes one or more collection electrodes 108, which in this example is a metallic mesh collection surface (e.g., a collection of interwoven large gauge metal wires). Fluid collection member 104 is grounded during operation. In this example, emitter electrode assembly member 102 and fluid collection member 104 are electrically insulated from each other by virtue of being physically unattached. Fluid collection member 104 may be placed in the way of a gas stream (e.g., exiting plume from a cooling tower) and one or more emitter electrodes 106 may be placed either just before or just after fluid collection member 104 in the direction of the gas stream. In some embodiments, first emitter electrode assembly member 102 is placed before fluid collection member 104 in a path of a gas stream and a second emitter electrode assembly member (e.g., constructed similarly to first emitter electrode assembly member 102) is placed after fluid collection member 104 in the path of the gas stream. During operation, one or more collection electrodes 108 are grounded.

Referring still to FIG. 1A, a high voltage at one or more emitter electrodes 106 can cause a corona discharge to occur at its vicinity. A cloud of space charges is generated and accelerated towards fluid (e.g., droplets of fluid, such as water) in a path of gas (e.g., air) stream. The space charges attach to fluid droplets 110 and the droplets become charged with the same sign as emitter electrodes 106. These charged droplets are then attracted to the grounded collection electrode 108 under the influence of the electric field between the emitter electrode assembly member 102 and fluid collection member 104. This additional force drives the charged fluid droplets 110 towards collection electrode 108. Some droplets may initially pass through collection electrode 108, but be redirected towards collection electrode 108, e.g., due to their charge. Alternatively or additionally, a second emitter electrode assembly member may be disposed on the other side of fluid collection member 104 to act similarly to first emitter electrode assembly member 102, but with an electric field that faces the opposite direct, thereby providing a strong redirection effect, possibly due in part to additional charging of droplets 110. When a droplet arrives at fluid collection member 104, it is captured and as soon as a few drops coalesce and become large enough to be shed by gravity, they drop. Fluid can be collected in a gutter to move the fluid away from collection panel(s) (as described further below). The fluid can be, for example, transported to a storage tank. In some embodiments, ionizing fluid in a gas stream to collect an amount of the fluid creates ozone. That ozone may be useful to disinfect the fluid in situ depending on what further use the collected fluid is intended for.

Figure 1B:
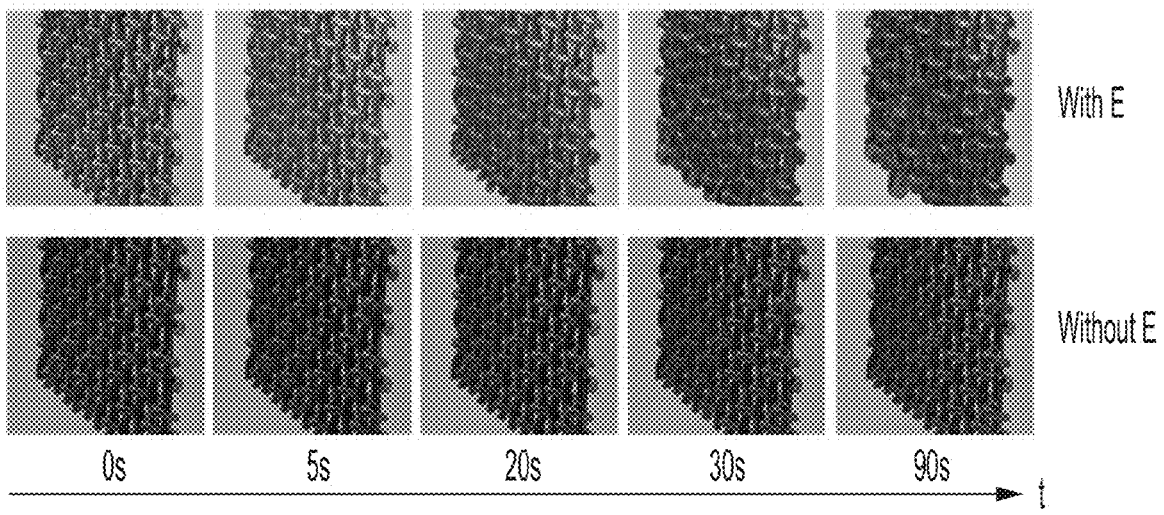
FIG. 1B shows images of fluid collection on a fluid collection member, according to illustrative embodiments of the present disclosure.
Figure 1C:
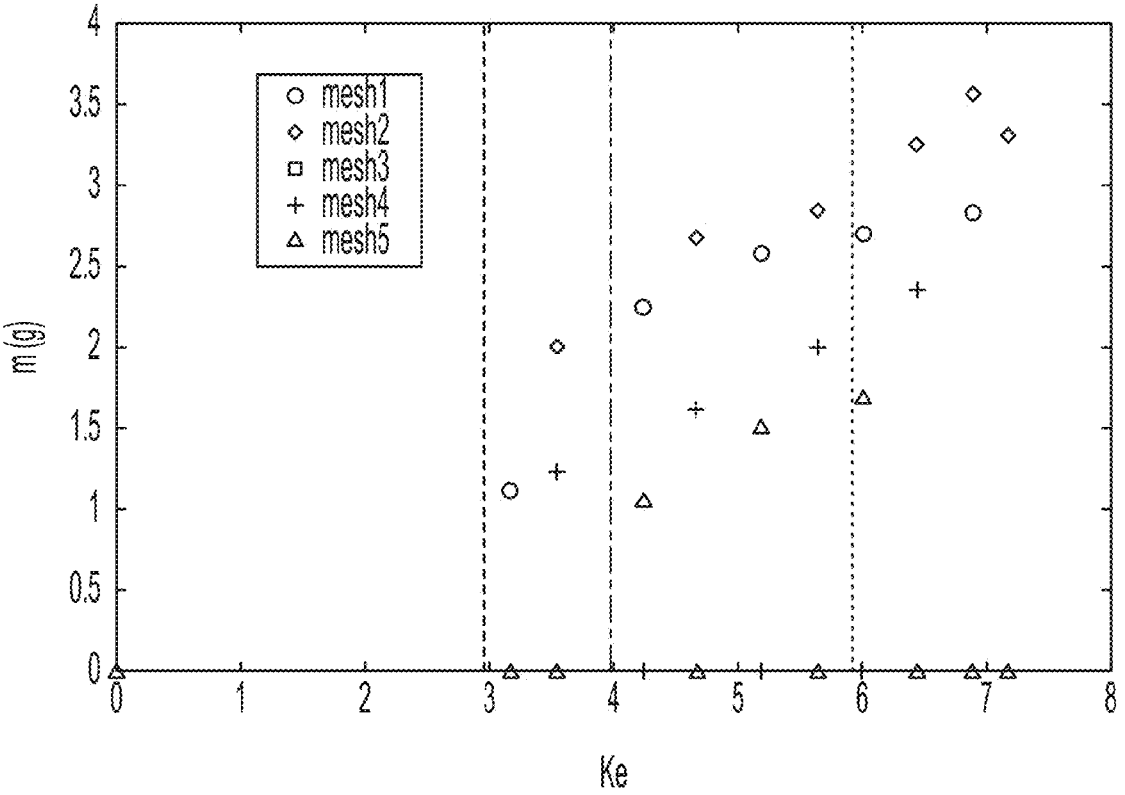
FIG. 1C shows a chart of the mass of fluid collected at different applied voltages for illustrative fluid collection systems, according to illustrative embodiments of the present disclosure.

FIG. 1B shows images of fluid collection at a mesh collection electrode arranged in accordance with FIG. 1A, according to illustrative embodiments of the present disclosure. In the first row, a 15 kV voltage was applied, while there was no electric field in the second row. Red dye was added to dispersed fog for visualization purposes. From the snapshots of the collection electrode at different time intervals of fog exposure as shown, it can be seen that there is a very large enhancement of fluid collection compared to passive meshes (that do not use an electric field). FIG. 1C shows a chart of the mass of the collected water as a function of $K_e$, a characteristic non-dimensional number that is a growing function of the voltage for different meshes. Measuring the mass of collected water, it is found that very high collection efficiencies, close to 100%, can be achieved for certain values of the operating voltage and certain mesh designs.

In some embodiments, methods described herein involve using a similar charging mechanism as described in relation to FIG. 1A to capture fluid (e.g., fog plume droplets), for example, cooling tower outlets. Systems can operate at low power, and no additional energy or equipment is needed to pre-condition a gas stream for fluid collection since condensation can happen at natural ambient conditions. Useful apparatus, systems, and methods that use one or more emitter electrodes and one or more collection electrodes to collect fluid from a gas stream that can be applied to the present disclosure are discussed in U.S. patent application Ser. No. 15/763,229, filed on Mar. 26, 2018, the content of which is hereby incorporated by reference in its entirety.

Figure 2:
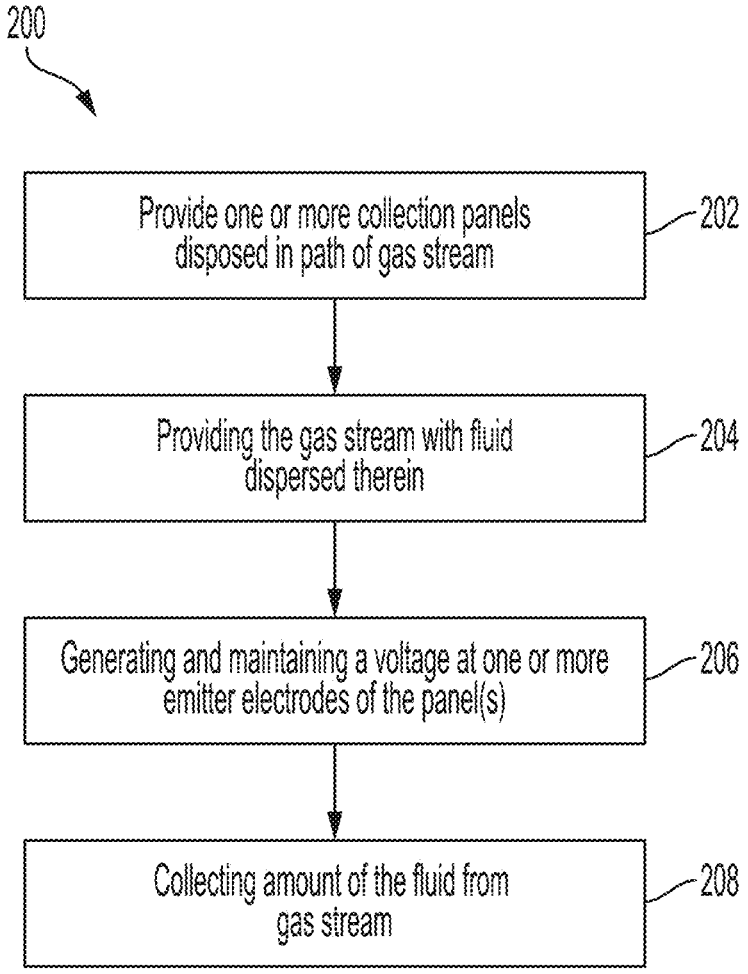
FIG. 2 is a flow diagram of a method for collecting fluid from a gas stream, according to illustrative embodiments of the present disclosure.

FIG. 2 is a flow diagram of a method 200 that can be used to collect fluid from a gas stream. In step 202, one or more collection panels are provided. The one or more collection panels are disposed in a path of a gas stream (e.g., air exiting a cooling tower). The one or more collection panels may be, for example, a collection panel in accordance with collection panel 100 described with respect to FIG. 1A previously or collection panel 200 described with respect to FIG. 5A later. In step, 204, the gas stream is provided with fluid dispersed therein. The fluid may be, for example, vaporized or aerosolized fluid. In step 206, a voltage is generated and maintained at one or more emitter electrodes of the one or more collection panels. The voltage may be, for example in a range from 1 kV to 500 kV (e.g., from 1 kV to 250 kV, from 1 kV to 100 kV, from 1 kV to 50 kV, from 1 kV to 25 kV, from 5 kV to 50 kV, from 25 kV to 50 kV, from 25 kV to 75 kV, from 50 kV to 100 kV, or from 50 kV to 250 kV). The voltage may be maintained for a period of time of, for example, at least 1 minute (e.g., at least 5 minutes, at least 15 minutes, at least 30 minutes, at least 1 hour, at least 2 hours, at least 4 hours, at least 8 hours, at least 10 hours, at least 12 hours, or at least 24 hours). In step 208, an amount of fluid is collected from the gas stream. The amount of fluid may be, for example, at least 10% (e.g., at least 25%, at least 40%, at least 50%, at least 60%, at least 75%, at least 80%, at least 85%, at least 90%, or at least 95%) of fluid dispersed in the gas stream that passes through the collection panel(s).

In some embodiments, the method comprises generating a corona discharge (e.g., by generating and maintaining the voltage at the one or more emitter electrodes). The amount of fluid may then be charged as (e.g., before and/or after) the amount of the fluid passes through the one or more emitter electrodes. The amount of fluid may then be deposited on the one or more collection electrodes of the one or more collection panels. In some embodiments, the method comprises forming a plurality of droplets on the one or more collection electrodes of the one or more collection panels. The droplets may coalesce on the one or more collection electrodes of each of the one or more collection panels and shed, at least in part due to gravity, from the collection panel(s). In order to remove the amount of fluid away from its origin (e.g., to avoid reinserting some fluid back into the gas stream), collected fluid may be redirected away from the collection panel(s). For example, one or more gutters may be used to direct fluid shed from one or more collection panels to a storage tank or other use (as described further in later paragraphs).

Fluid used for cooling may be, for example, water such as brackish water or seawater. Collecting fluid from a gas stream may have an added benefit of desalinizing water while also abating plume. That is, seawater may be used, for example for cooling, and pure, unsalinated water may be collected using a system described herein. In some embodiments, the system is combined with a cooling tower using seawater or other brackish water as feedwater, resulting in an ultra-low cost desalination system. A coastal power plant may use seawater in a cooling tower and an installed fluid collection system can then collect pure water coming out of the cooling tower, which can be used for domestic, industrial or agricultural needs.

Figure 3A:
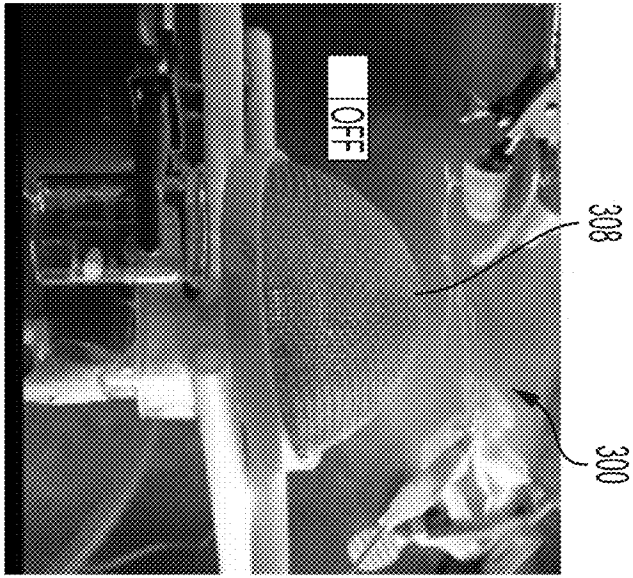
FIGS. 3A and 3B are photographs of an example of a fluid collection system with voltage turned off and on, respectively, according to illustrative embodiments of the present disclosure.
Figure 3B:
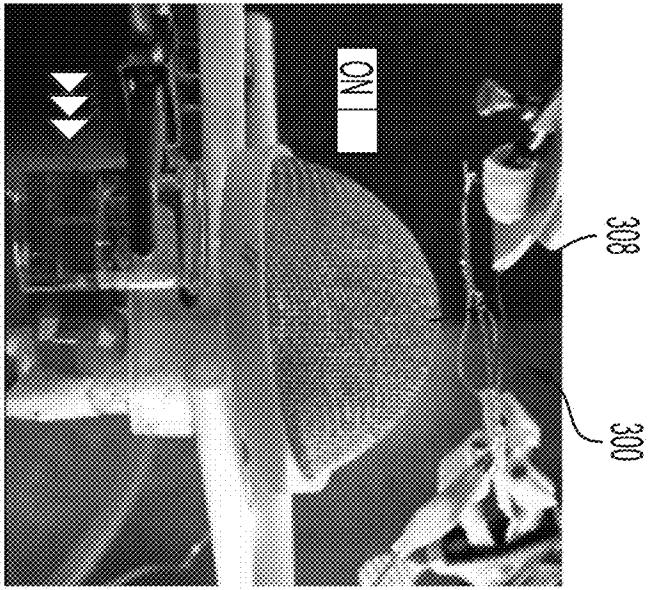

FIGS. 3A-3B are photographs of a collection panel 300, according to illustrative embodiments of the present disclosure. A vertical tube with a plume of water droplets mimics a cooling tower and collection panel 300 is placed over an outlet of the tube. Collection panel 300 is dome-shaped (i.e., is not flat). With the voltage (and thus electric field) off at emitter electrode(s) of collection panel 300, the plume is unaffected, as shown in FIG. 3A. However, when the voltage (and thus electric field) is turned on at emitter electrode(s) of collection panel 300, the plume is abated nearly instantaneously and fluid (water in this example) starts to be collected using collection panel 300. Droplets come to the mesh metal collection surface 308 of collection panel 300, grow in size as they coalesce and eventually shed by gravity when they reach a critical size. In this example, they shed along the wires of the mesh and are collected in a secondary collection tank then transferred to a storage area. In this example, the collection efficiency of collection panel 300 was approximately 80% (measured as a percentage of the emitted water).

Figure 3C:
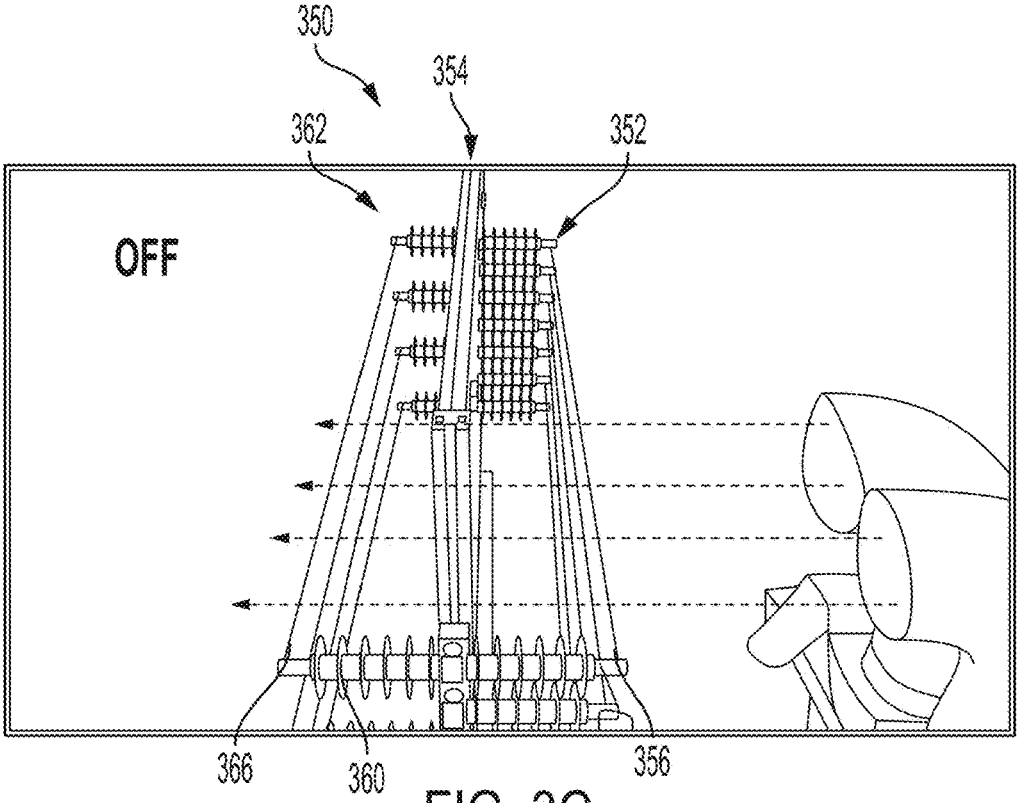
FIGS. 3C and 3D are views of an example of a fluid collection system with voltage turned off and on, respectively, according to illustrative embodiments of the present disclosure.
Figure 3D:
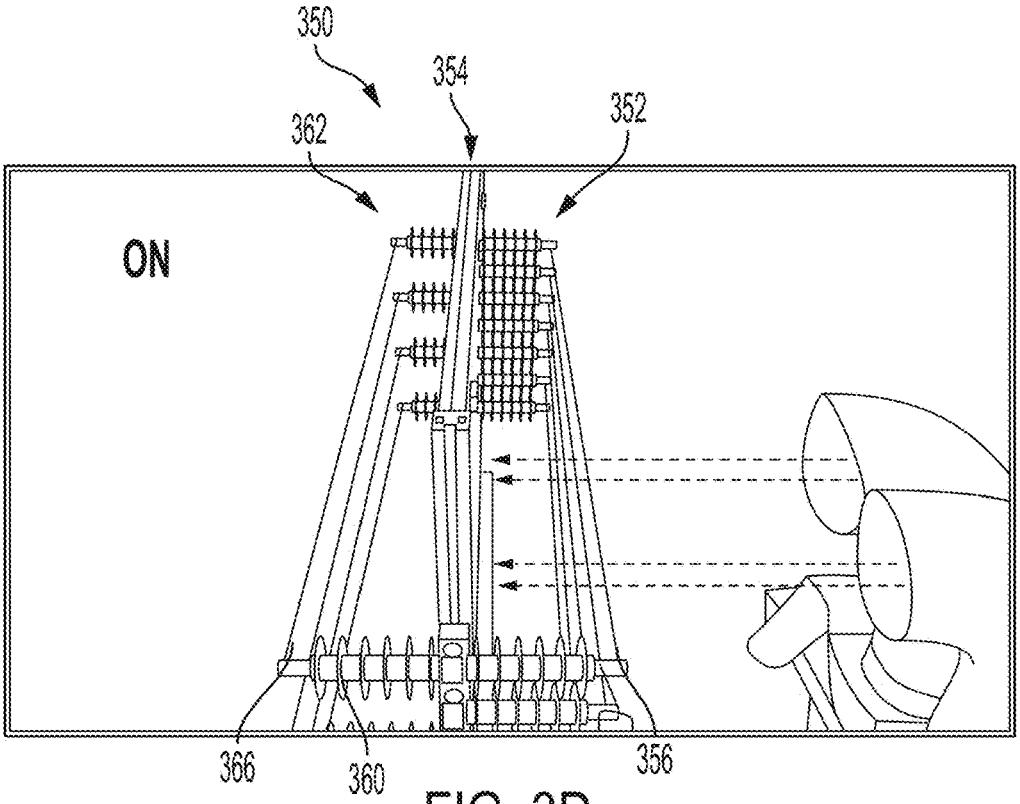
Figure 3E:
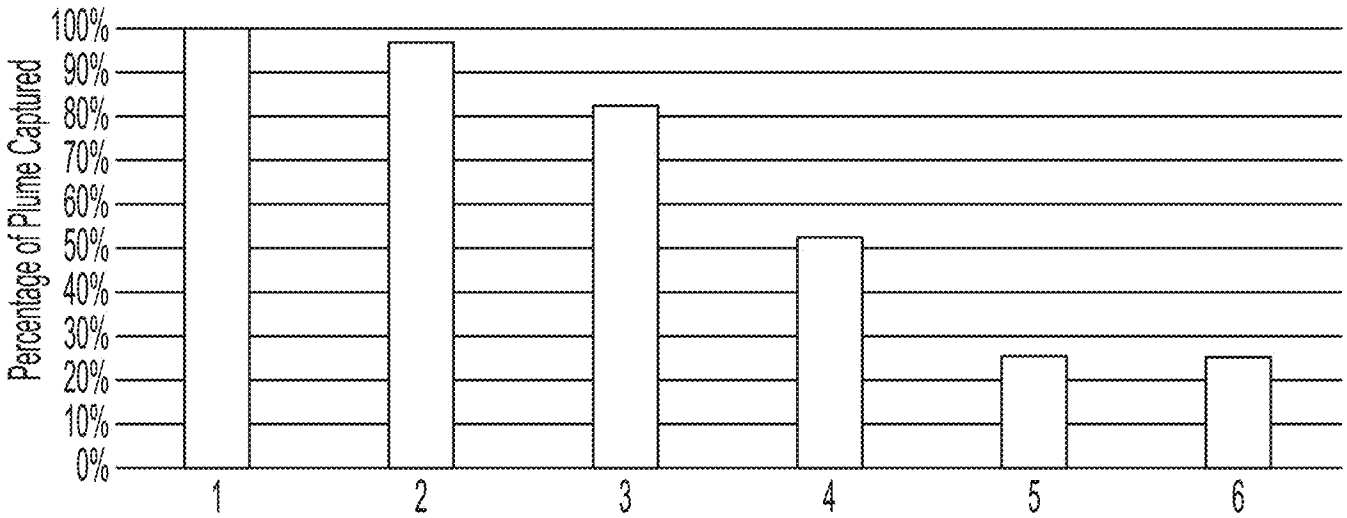
FIG. 3E is a chart of plume collection efficiencies as a percentage achieved by certain examples of fluid collection systems with different configurations, according to illustrative embodiments of the present disclosure.

FIGS. 3C-3D are views of a collection panel 350 in use, according to illustrative embodiments of the disclosure. Collection panel 350 includes fluid collection member 354, first emitter electrode assembly member 352, and second electrode assembly member 362. Fluid collection member 354 includes one or more collection electrodes (not labeled) attached to a collection frame. First and second emitter electrode assembly members 352, 362 are physically attached to and electrically insulated from fluid collection member 354 by electrically insulating members 360 (e.g., in accordance with FIG. 5B described in later paragraphs). First emitter electrode assembly member 352 includes a plurality of metal wires 356 that act as emitter electrodes. The wires may be snaked back and forth several times each or may run point to point from one end of first emitter electrode assembly member 352 to another. Second emitter electrode assembly member 362 includes a plurality of metal wires 366 that act as emitter electrodes. The wires may be snaked back and forth several times each or may run point to point from one end of second emitter electrode assembly member 362 to another. Second emitter electrode assembly member 362 is disposed on an opposite side of fluid collection member 354 as first emitter electrode assembly member 352 and fluid collection member 354 is disposed at least partially between first emitter electrode assembly member 352 and second emitter electrode assembly member 362. Fluid that passes through fluid collection member 354 may be redirected towards fluid collection member 354 by second emitter electrode assembly member 362. FIG. 3C shows plume going through the collector when the electric field is off and FIG. 3D shows complete plume abatement when the electric field is on. FIG. 3E is a chart of collection efficiencies in different configurations, according to illustrative embodiments of the present disclosure. It can be seen that by appropriately varying parameters such as electrode size, shape; operating voltage; and collection electrode size, shape, and arrangement, efficiencies of up to effectively 100% plume capture can be achieved.

Figure 4A:
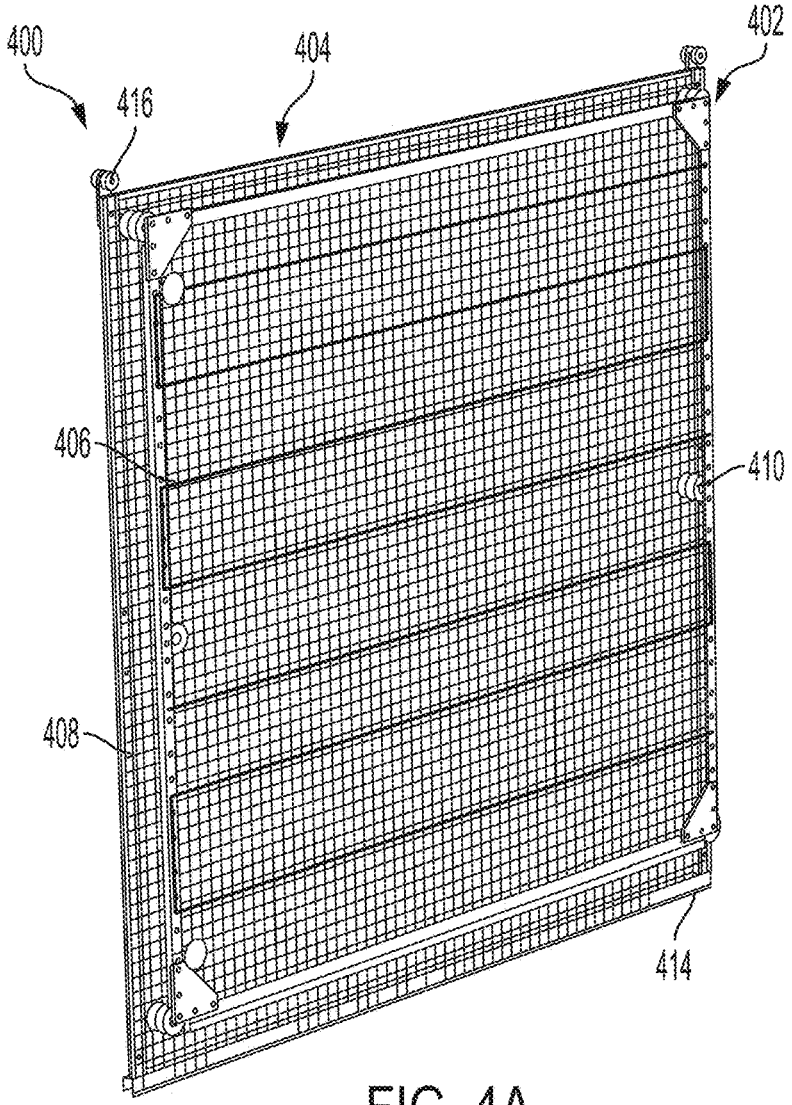
FIG. 4A is a view of a modular collection panel, according to illustrative embodiments of the present disclosure.

FIG. 4A is an illustration of an example of a modular collection panel 400 according to illustrative embodiments of the disclosure. Modular collection panel 400 includes emitter electrode assembly member 402 and fluid collection member 404. Emitter electrode assembly member 402 is physically attached to and electrically insulated from fluid collection member 404 by six electrically insulating members 410 (shown in detail in FIG. 4B). Fluid collection member 404 includes one or more collection electrodes attached to a collection frame that includes a J-edge 414 (described further with respect to FIGS. 4E-F). The one or more collection electrodes is a metallic mesh collection surface 408. Emitter electrode assembly member 402 includes a metal wire electrode 406 that is snaked around and attached to an assembly frame. Modular collection panel 400 also includes rotatable trolley members 416 that can be used for mounting and dismounting collection panel 400 using track 418 that is a portion of frame 450 (shown in FIG. 4D). In modular collection panel 400, fluid collection assembly 404 is larger in area (e.g., by from 5% to 10%) than emitter electrode assembly 402. Modular collection panel 400 is flat and rectangular in shape. In some embodiments, a modular collection panel is instead triangular in shape.

Figure 4B:
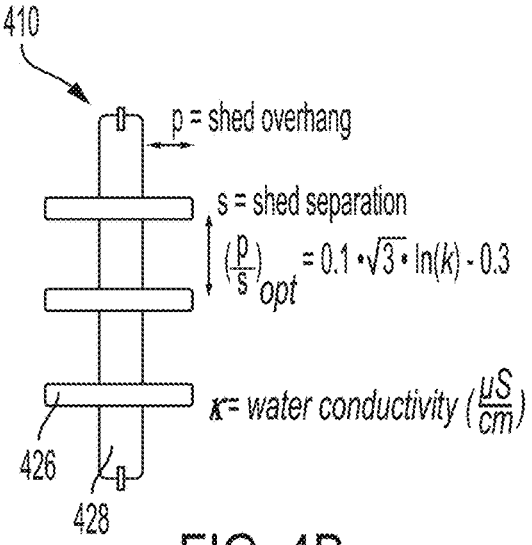
FIG. 4B is a cross section of an electrically insulating member, according to illustrative embodiments of the present disclosure.

FIG. 4B is a cross section of electrically insulating member 410, according to illustrative embodiments of the present disclosure. In some embodiments, sheds 426 are utilized to breakup surface conduction pathways from end-to-end of the electrically insulating member and to prevent from surface arcing or surface electrical breakdown. The insulator material, shed geometry and overall dimensions can be selected to optimize electrically insulating member's 410 resistance to shorting in wet conditions. Generally, for example, hydrophobic materials that have high dielectric strength (e.g., over 300 kV/cm) are useful. For example, in some embodiments, electrically insulating members are fabricated from polytetrafluoroethylene (PTFE) cylinders owing to both the dielectric properties (dielectric strength of about 600 kV/cm) and the hydrophobic nature of the material (surface energy of about 20 mN/m). The hydrophobicity of PTFE facilitates the effective drainage of water during a wetting event preventing arcing due to stagnant water patches along the surface of electrically insulating member 410.

In some embodiments, insulator sheds 426 of electrically insulating member 410 are designed to have a particular radius relative to the radius of core 428 of electrically insulating member 410. The difference between these two values is known as the "shed overhang" dimension of electrically insulating member 410. Nearby sheds 426 can be spaced by a certain dimension that evenly spaces sheds 426 along core 428 of electrically insulating member 410 setting a pitch or shed separation between adjacent sheds 426. The ratio of the shed overhang to the shed pitch can then kept at or above a certain optimal ratio based on empirical data that correlates the optimal ratio as a function of the conductivity of the water electrically insulating member 410 is being sprayed with or exposed to (see FIG. 4B for detail). This ratio increases as the water draining along electrically insulating member 410 increases in conductivity. The overall length of electrically insulating member 410 may be chosen based on an optimal operating distance between emitters and collectors (e.g., chosen to optimize system electrical or collection efficiency). In some embodiments, electrically insulating member 410 includes 60° knife-edge along the outside edge of sheds in order to allow for droplets to drain effectively from each shed and to avoid any pooling on the bottom edge of the shed.

Figure 4C:
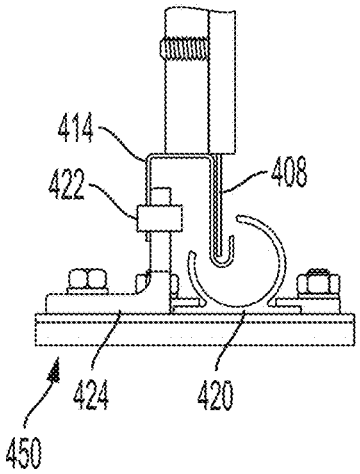
FIG. 4C is a view of a portion of a frame and a portion of a modular collection panel, according to illustrative embodiments of the present disclosure.
Figure 4D:
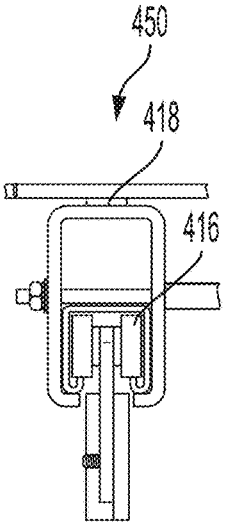
FIG. 4D is a view of a portion of a frame and a portion of a modular collection panel, according to illustrative embodiments of the present disclosure.
Figure 4E:
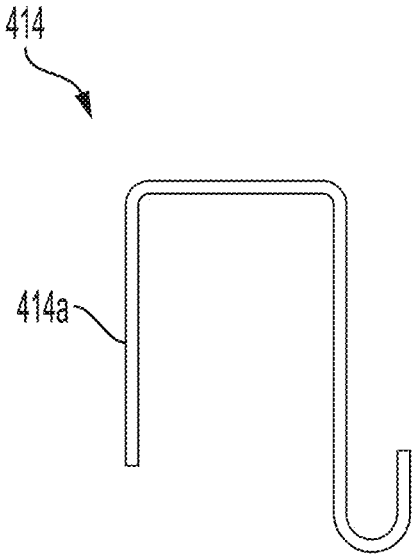
FIG. 4E is a cross section of a J-edge, according to illustrative embodiments of the present disclosure.
Figure 4F:
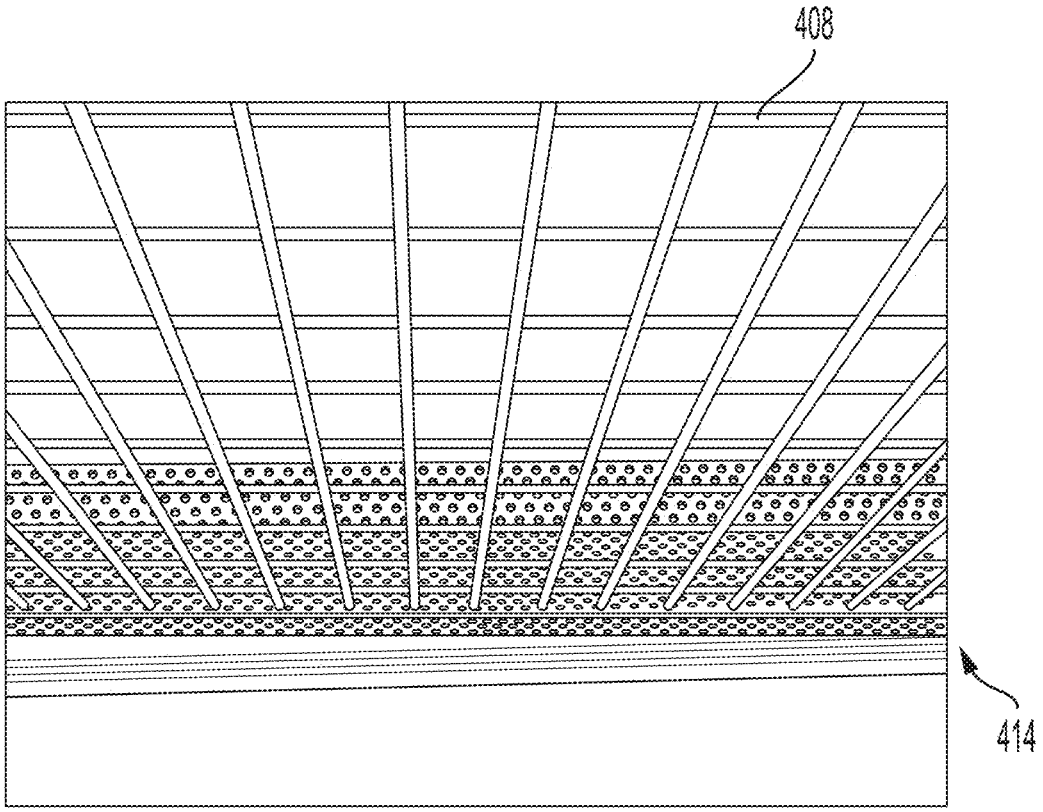
FIG. 4F is a view of a portion of a modular collection panel, according to illustrative embodiments of the present disclosure.

Modular collection panel 400 may be constructed to be attached to frame 450 (e.g., at the bottom of modular collection panel 400), for example using J-edge 414 as shown in FIG. 4C. J-edge 414 is shown in isolation in FIG. 4E. As shown in FIGS. 4C and 4F, frame 450 also includes gutter 420 and panel connection point 424. As shown in FIG.

4C, a portion of J-edge 414 and a portion of collection surface 408 are at least partially surrounded by gutter 420, which can improve fluid collection as compared to more open designs for gutter 420. Gutter 420 may be a respective gutter (e.g., for a single panel) or part of a common gutter (e.g., for a subset of or all collection panels in a system). Gutter 420 may be made from a durable plastic such as high-molecular polyethylene. Modular collection panel 400 may drain collected fluid, at least in part due to gravity, through a bottom J-edge portion of a collection frame into gutter 420. The bottom portion may be perforated, for example as shown in FIG. 4F, in order to allow rapid fluid drainage. J-edge 414 is disposed around at least a portion of the perimeter of one or more collection electrodes (e.g., mesh collection surface 408 in this example) to allow for easy handling and/or provide rigidity to the one or more collection electrodes. Modular collection panel 400 may be attached to J-edge by, for example, one or more tack welds. Modular collection panel 400 may be connected (e.g., at its bottom) to panel connection point 424 of frame 450 by clamp 422. For example, J-edge 414 includes portion 414*a* which is flat and oriented to be clamped to panel connection point 424. Clamping may allow for maintaining proper spacing of panels on a frame and/or avoiding fatigue failures due to unnecessary vibrations of the panels.

Various collection panels (e.g., modular collection panels) that can be used or adapted for use in systems and methods disclosed herein are described in U.S. Provisional Patent Application No. 62/881,691, filed on Aug. 1, 2019, the disclosure of which is incorporated by reference herein in its entirety.

Figure 5:
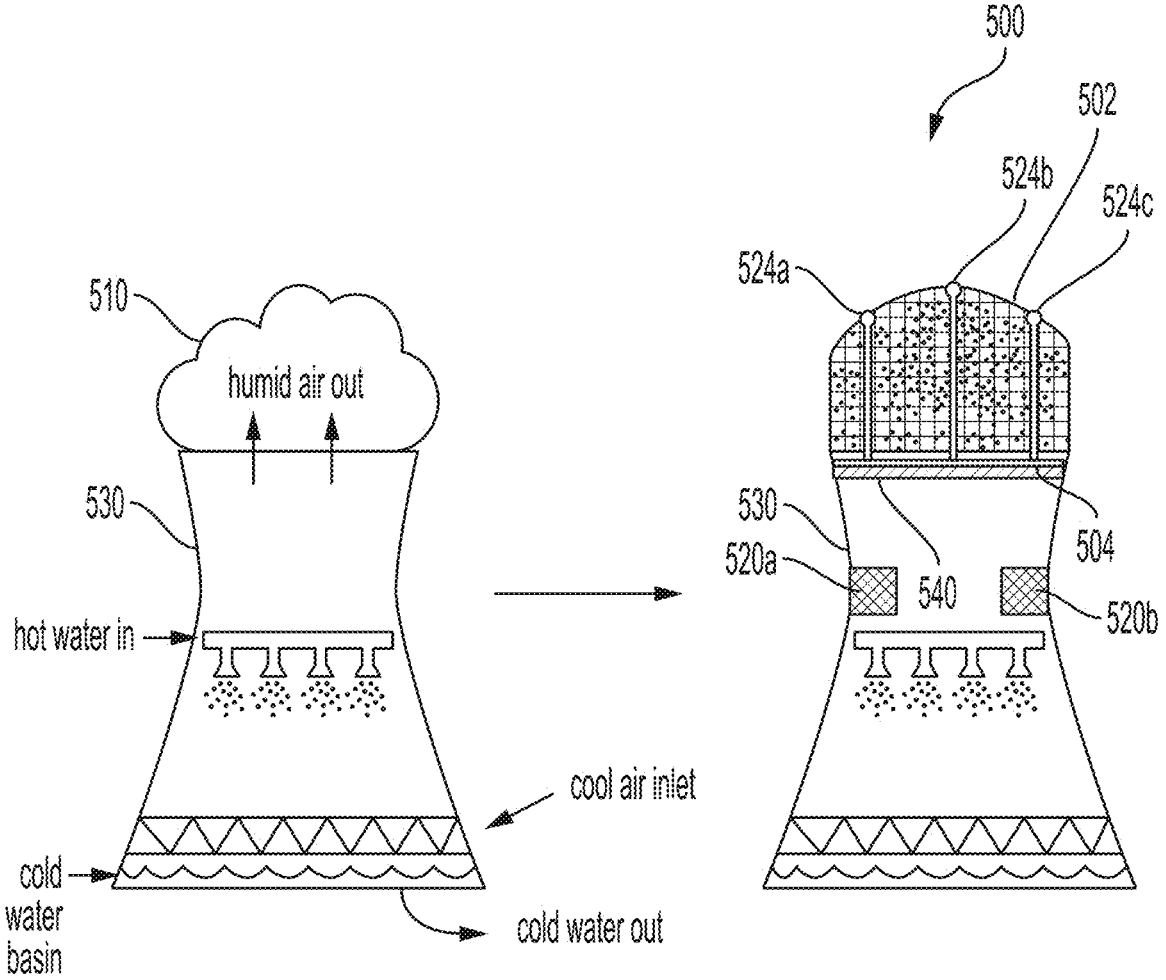
FIG. 5 is a schematic comparison of a cooling tower with and without a fluid collection system installed, according to illustrative embodiments of the present disclosure.

FIG. 5 is a schematic comparison of a cooling tower 530 before and after fluid collection system 500 is mounted thereon, according to illustrative embodiments of the present disclosure. One or more collection panels 502 are placed near (e.g., above) cooling tower 530. One or more collection panels 502 include electrically conductive mesh or porous collection surface(s), which is (are) visible in FIG. 5. The system can include one single collection panel or it can include a plurality of modular collection panels (e.g., in accordance with FIGS. 4A-4E). Whether one or a plurality of collection panels are included, the one or more collection panels may span a path of a gas stream (e.g., the entire area of a cooling tower outlet). As shown in FIG. 5, one or more collection panels 502 are attached to frame 504 at one or more panel connection points 524*a-c*. Panel connection points 524*a-c* may include, for example, one or more points to hold welds, fasteners (e.g., bolts, screws, or rivets), or clamps. For example, a panel connection point may be a flange (e.g., with a predrilled hole) protruding from a frame. Frame 504 is sized and shaped to be disposed near (e.g., on or in) (e.g., within 25 m or within 10 m of) the cooling tower outlet. One or more collection panels of a system may be disposed, for example, outside or inside of a gas outlet or inside a duct. In some embodiments, a portion of frame 504 is disposed inside of a gas outlet while another portion is disposed outside of a gas outlet, for example as shown in FIG. 5 for cooling tower 530. Frame 504 is attached to cooling tower 530 through a portion that is inside of cooling tower 530 (shown by the horizontal line in frame 504) and collection panel(s) 502 is (are) attached to a portion of frame 504 that is outside of cooling tower 530. FIG. 5 shows how placement of fluid collection system 500 can abate plume 510 and collect fluid that was in plume 510 (shown on right) as compared to a cooling tower 530 without fluid collection system 500 (shown on left).

Figure 6A:
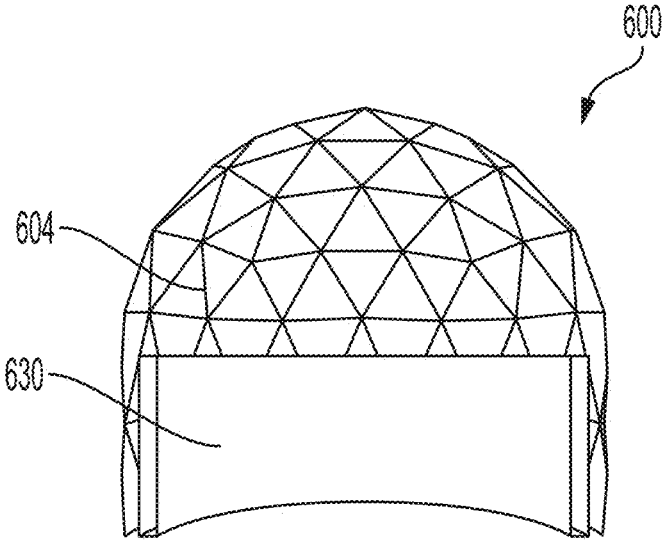
FIGS. 6A and 6B are a schematic and photograph, respectively, of a fluid collection system, according to illustrative embodiments of the present disclosure.
Figure 6B:
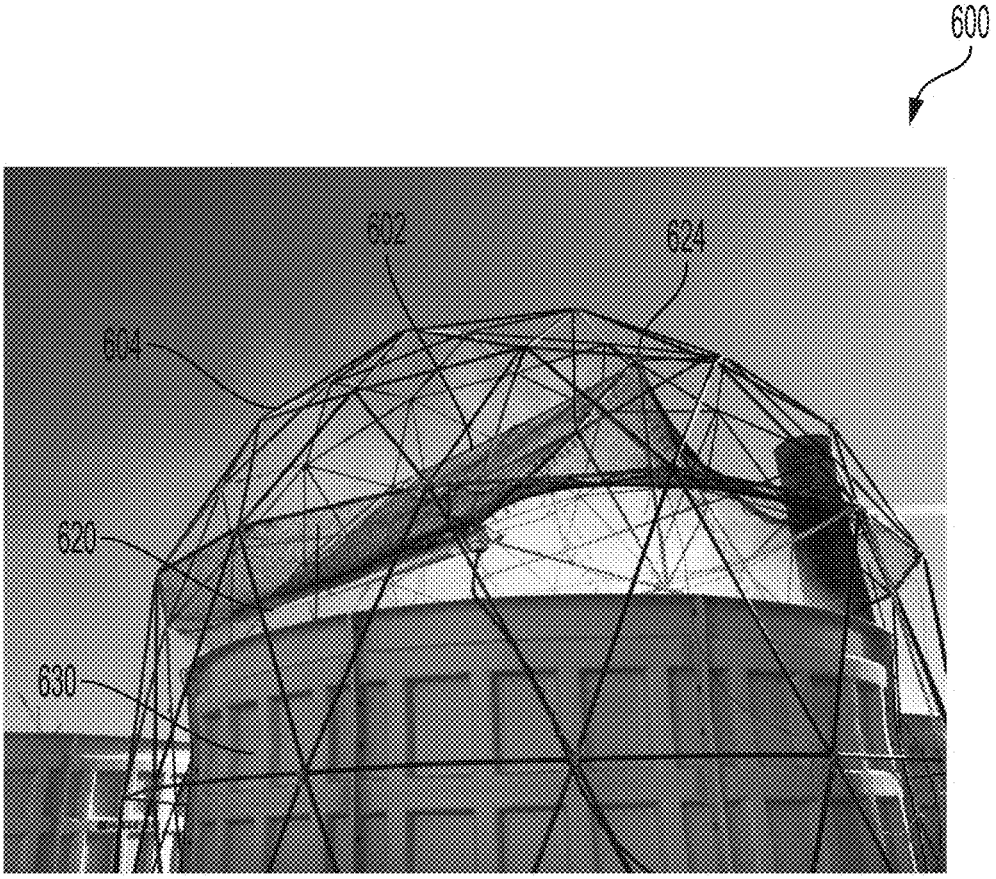
Figure 7A:
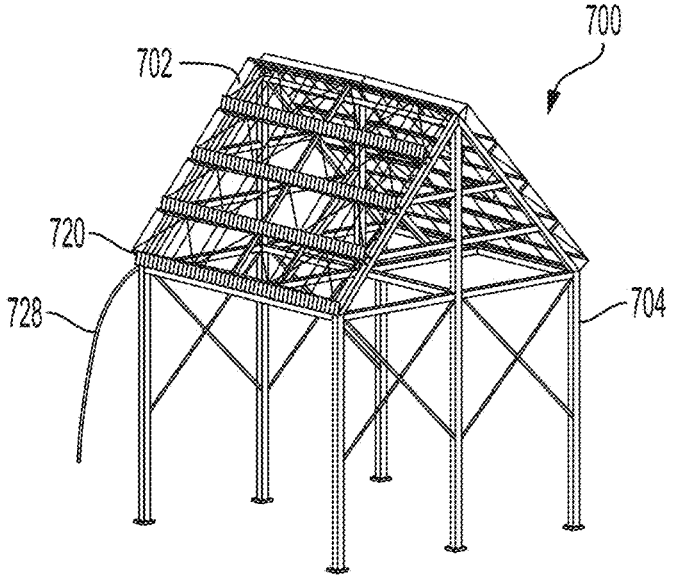
FIGS. 7A-7E are schematics of a fluid collection system, according to illustrative embodiments of the present disclosure.
Figure 7B:
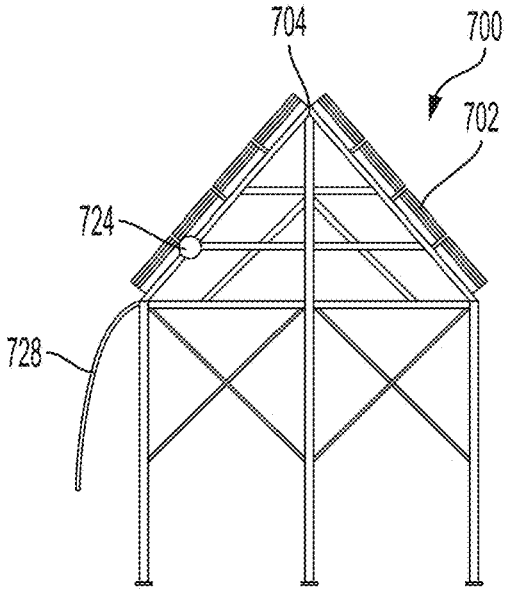

A frame that attaches one or more collection panels may be any suitable shape and size for its intended installation site. As non-limiting examples, a frame may include a dome-shaped, triangle-shaped, arch-shaped, or pyramid-shaped portion. A frame may hold one or more collection panels in a flat (e.g., horizontal or vertical) arrangement, such as in a two-dimensional array. A frame with a dome-shaped portion is shown in FIG. 5. Another example of a dome-shaped portion is shown in FIGS. 6A and 6B. A frame with a triangle-shaped portion is shown in FIG. 7A. (FIGS. 6A, 6B, and 7 are discussed further in later paragraphs.)

In some embodiments, one or more collection panels are disposed to maximize fluid collection. For example, a plume from a cooling tower being abated is in transient state. The plume starts as saturated air at the outlet of the cooling tower, condenses as supersaturated conditions are reached, and then evaporates again when more air gets mixed in. Thus, in some embodiments, there may be only a relatively small spatial window where water droplets are in the air and collection may preferably occur there. Models have been developed to predict the surface of maximum fluid content so that collection panel(s) can be placed at the location where it can collect the most. A location (or range of locations) of a surface of maximum water content can also be determined empirically from measurements (e.g., humidity measurements) at various times (e.g., under various ambient conditions). A surface of maximum fluid content can be a planar surface or a non-planar surface (e.g., three-dimensionally rounded surface). The physical location and shape of a surface may depend on, for example, the geometry of an air outlet or duct, the amount of fluid dispersed in the gas stream, and ambient conditions such as temperature and pressure. The physical location or shape of a surface may change based on a change in wind velocity (e.g., direction and/or speed). Arranging collection panel(s) relatively far away from a surface of maximum fluid content may reduce fluid collection. Thus, in some embodiments, a the frame is disposed near a gas outlet such that one or more collection panels are disposed within 8 m (e.g., within 5 m or within 3 m) of a surface of maximum fluid content of gas exiting the gas outlet. In some embodiments, fluid collection is mostly or totally agnostic to the particular location of collection panel(s), for example where the fluid distribution throughout a gas stream is relatively uniform, such as in the middle of a duct.

In some embodiments, collection panel(s) are mounted on a motion stage so their location can be adapted, for example due to changes in a location of surface of maximum fluid content (e.g., in the case of strong winds or other ambient conditions). Referring back to FIG. 5 as an example, frame 504 is mounted on motion stage 540, which is attached to cooling tower 530. (Frame 504 can be considered as attached to cooling tower 530 through motion stage 540.) Motion stage 540 may be operable to move frame (e.g., up or down) in order to adjust a position of collection panel(s) 502 based on changes in ambient conditions (e.g., temperature, pressure, or wind velocity). Motion stage 540 may adjust the position of collection panel(s) 502 in order to enhance fluid collection after conditions have changed, for example. Motion stage 540 may have some range of associated motion such as, for example, a range of motion of no more than 20 m (e.g., no more than 10 m, no more than 5 m, or no more than 1 m). A motion stage may be automatically or manually operable. A motion stage may include one or more jack screws or one or more actuators (e.g., hydraulic, pneumatic, or electrical actuators). A motion stage may also be similarly used in combination with the example fluid collection systems of FIGS. 6A-B and 7, for example.

The wire and opening sizes in a mesh collection surface of a fluid collection member of a collection panel can be chosen to optimize the fluid collection/pressure drop tradeoff. Large enough openings ensure a negligible back-pressure on a gas stream (e.g., at the fans of a cooling tower). A fluid collection system can still achieve very high collection efficiencies with larger meshes by tuning the electric field caused by the voltage at one or more emitter electrodes of an emitter electrode assembly member of one or more collection panels. In some embodiments, a fluid collection system includes two or more layers of collection panels (e.g., disposed sequentially with respect to a direction of gas flow in a gas stream).

In some embodiments, a cooling tower is combined with a fluid collection system where an optimization algorithm of the tower is modified to optimize for both fluid and energy consumption. Currently, the temperature of the recirculating water in cooling towers is mostly selected to optimize for energy costs (e.g., based on energy for pumping). By adding a fluid collection system, a new optimization may factor fluid in the equation and lead to more savings.

In some embodiments, the electric field between emitter electrode(s) and collection electrode(s) creates what is sometimes referred to as an "electric wind." Moving ions in gas (e.g., air) accelerate gas molecules and create an airflow (hence "wind"). This additional gas flow in the normal direction of the gas flow can reduce the pressure drop through a collection panel (e.g., through a mesh collection surface thereof) and reduce or alleviate any impact on overall performance (e.g., of a cooling tower) that a fluid collection system may otherwise have.

In some embodiments, a fluid collection system includes one or more additional components. For example, fluid collection system 500 includes additional components 520*a-b*, shown in FIG. 5. An additional component may be disposed a distance away from one or more collection panels (e.g., inside of a cooling tower). Examples of additional components are cooling mechanisms, humidifying mechanisms, and particle injectors. Additional components 520*a-b* are shown as being inside cooling tower 530, but in some embodiments, one or more additional components are physically disposed outside of cooling tower or duct (even if they operate to alter conditions inside the cooling tower or duct). Generally, although not necessarily, an additional component is disposed in a direction of gas flow of a gas stream before one or more collection panels, for example for reasons which will become clear in the following paragraphs.

A cooling mechanism may supply cooling, for example, through heat exchangers (e.g., external heat exchangers). In an example of a fluid collection system for a cooling tower, a cooling mechanism may be used when the ambient weather conditions are such as an additional cooling of the exiting air results in more fog production and thereby more water recovery during operation. Cooling can also be done directly on one or more collection electrodes of a collection panel, making the electrode(s) serve as both a collection site for already formed droplets and a condensation site for flowing vapor.

A humidifying mechanism may be used to promote fog production in order to improve fluid collection. In an example of a fluid collection system for a cooling tower, waste vapor from a plant cooled by the cooling tower (e.g., a power plant) can be used to humidify the tower outlet in order to encourage further fog production in order to increase fluid collection.

In some embodiments, a fluid collection system includes a particle injector. By injecting small particles that can act as condensation nuclei, a condensation rate is increased (e.g., by lowering the supersaturation needed for condensation is lowered). Using a particle injector may result in more fog formation. A particle injector may inject charged particles. A particle injector may inject particles of different sizes. For example, particles injected into a gas stream by a particle injector may have a multimodal size distribution. Particles injected by a particle injector may be pre-cooled (relative to an ambient temperature of a gas stream) before injection. Depending on the application and working conditions, these particles may or may not be filtered out after the fluid is collected at one or more collection panels, for example using an intermediate filter.

FIG. 6A is a schematic of a fluid collection system 600 with a frame 604 comprising a dome-shaped portion, according to illustrative embodiments of the present disclosure. FIG. 6B is a photograph of fluid collection system 600 that includes frame 604 (having a dome-shaped portion) installed on a 20-foot cooling tower. Fluid collection system 600 includes collection panel 602, frame 604, and gutter 620. Frame 604 includes panel connection points 624 to which panel 602 is attached. Frame 604 is sized and shaped to be disposed near cooling tower 630. In this example, frame 604 is positioned around an outlet of cooling tower 630. In use, fluid is collected at collection panel 602 and shed, at least in part due to gravity, into gutter 620 and then carried away from cooling tower 630 [e.g., using fluid conduit (not shown)]. In some embodiments, triangular shaped flat collection panels are used with frame 604 instead (and gutter 620 is modified appropriately, as needed or desired, as well). Experiments have been conducted to measure water collection in an experimental cooling tower and water quality has been tested with the results shown below in Table 1 (where TDS stands for "Total Dissolved Solids" and "basin water" refers to water in a basin of the experimental cooling tower).

TABLE 1

| Date | Start Time | Basin Water TDS (mg/L) | Collected Water TDS (mg/L) | City Water TDS (mg/L) | Basin Water Conductivity (μS/cm) | Collected Water Conductivity (μS/cm) | City Water Conductivity (μS/cm) |
|---|---|---|---|---|---|---|---|
| Nov. 29, 2018 | 10:32 | 2640 | 404 | | 4060 | 621 | |
| Nov. 29, 2018 | 12:15 | 2640 | 404 | | 4060 | 621 | |
| Dec. 5, 2018 | 10:24 | 2600 | 350-400 | | 4010 | 538-616 | |
| Dec. 5, 2018 | 11:15 | 2600 | 350-400 | | 4010 | 538-616 | |
| Dec. 6, 2018 | 9:45 | 2630 | 463 | 501 | 4050 | 712 | 770 |

Collected fluid may be much purer than source fluid that is then later dispersed in a gas stream. For example, collected water can be much purer than circulating water in a cooling tower. Contamination may enter collected fluid from the presence of drift that is also collected with the distilled water in the plume. In some embodiments, collected fluid has a purity (e.g., contaminants concentration) that is at least 5× and no more than 50× higher (e.g., at least 5× and no more than 50× lower contaminants concentration) than a purity of the fluid before the fluid entered the gas stream. In the example of FIG. 6B, contaminants concentration in the collected water was 6 to 7 times lower than in the cooling tower water and was even lower than drinking water from the city of Cambridge, Mass. at a similar time period (as shown in Table 1). The simple experimental example of FIG. 6B is a case with relatively low fluid collection and high drift. In other use cases, such as in a cooling tower of a commercial power plant, collected fluid (e.g., water) may be much purer. Accordingly, collected water may be used as a source of fresh water, as the water does not have to be used for cooling but can be used for other municipal uses. For example, fluid conduit can carry collected fluid away from collection panel(s) and towards a storage tank, municipal water system, or other water circulating system.

Figure 7C:
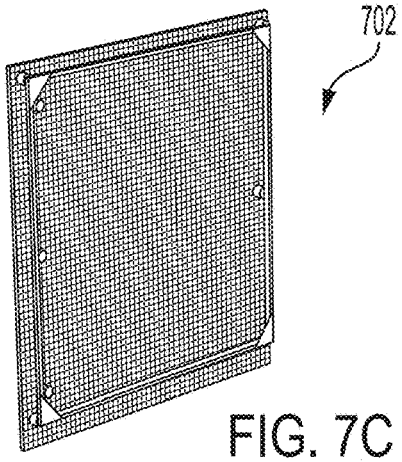

FIGS. 7A-7E are schematics of a fluid collection system 700 according to illustrative embodiments of the disclosure. Fluid collection system 700 includes frame 704, modular collection panels 702, gutters 720, panel connection points 724, actuators 726, and fluid conduit 728. A representative modular collection panel 702 is shown in FIG. 7C and may be constructed, for example, in accordance with or adapted from modular collection panel 400 shown in FIGS. 4A-4F.

Frame 704 has a triangle-shaped portion to which modular collection panels 702 are attached at panel connection points 724. (One representative connection point is shown and labeled.) Modular collection panels 702 are disposed at an angle on frame 704, which can help with shedding fluid collected at the panels. For example, in some embodiments, collection panel(s) are disposed at an angular orientation on a frame to assist in drainage of collected fluid. Collection panel(s) may be mounted on a frame, for example, at an angle from 30 degrees to 60 degrees, such as at about 45 degrees, relative to level ground. Falling droplets may not be desirable (e.g., inside a cooling tower where they can fall on a fan), so a frame may be sized and shaped so that collection panel(s) are angled when attached, to shed water away from a gas stream. An angled orientation may be at an angle from 30 degrees to 60 degrees (e.g., about 45 degrees). A slope of collection panels may be engineered to be large enough to promote side shedding instead of collected fluid shedding directly downward. Surface properties of one or more collection electrodes (e.g., an electrically conductive mesh collection surface) can also be tuned to have a low contact angle hysteresis, thereby promoting rapid shedding and avoiding clogging. In some embodiments, a collection surface has a low contact angle hysteresis when the one or more collection panels are connected to the frame (e.g., of no more than 40 degrees difference between a receding contact angle and an advancing contact angle).

Fluid collected at collection panels 702 is directed into gutters 720 and then further directed into fluid conduit 728. In this example, each gutter 720 is common for a respective subset of modular collection panels 702. In some embodiments, a gutter is common to a subset or all of one or more collection panels. In some embodiments, each collection panel has a corresponding individual gutter.

Fluid conduit 728 may be in fluid contact with one or more collection panels 702 and, for example, one or more of a cold-water return, a hot water line, a basin of a cooling tower, and a water distribution system such that collected fluid can flow from collection panel(s) 702 through fluid conduit 728 to the return, line, basin, or system, respectively. Fluid conduit 728 may be in fluid contact with one or more collection panels 702 and, for example, a storage tank such that collected fluid can flow from collection panel(s) 702 through fluid conduit 728 to the storage tank. Fluid conduit as described in reference to FIGS. 7A-7E can be used or adapted for use, for example, with the examples of fluid collection systems shown in FIGS. 3A-3D, 5, and 6A-6B. An intermediate filter may be disposed in a path of fluid flow through fluid conduit 728 in order to filter collected fluid. For example, an intermediate filter may be used to filter particles that had been injected by a particle injector. Fluid conduit may include, for example, one or more pipes and/or one or more hoses.

Figure 8A:
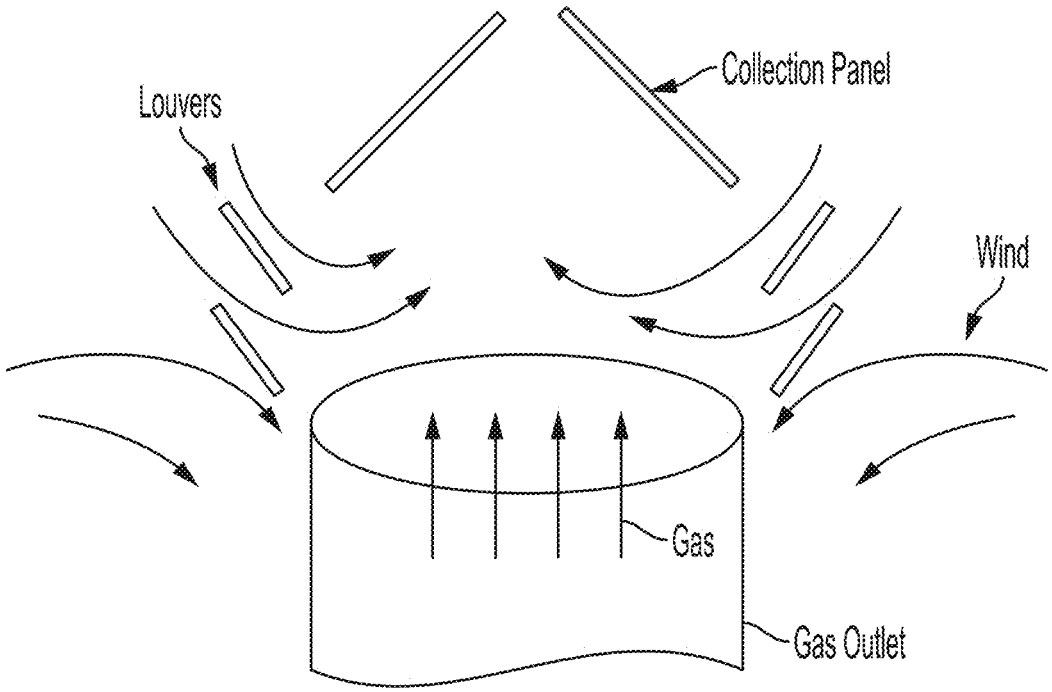
FIGS. 8A-8B show examples of species collection systems that include one or more wind breaks, according to illustrative embodiments of the present disclosure.
Figure 8B:
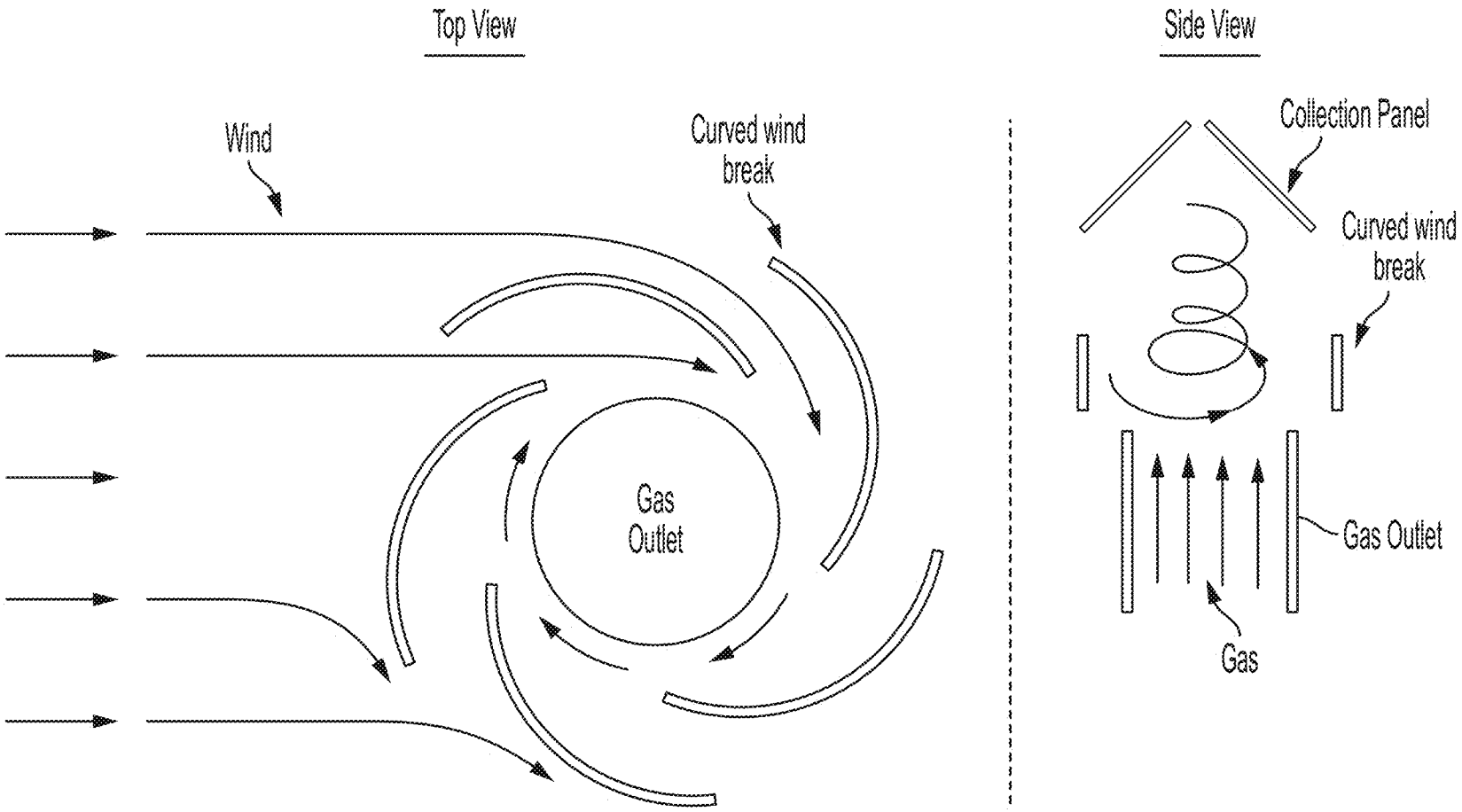

In some embodiments, for example as shown in FIGS. 8A-8B, one or more wind breaks may be disposed above or after a gas outlet and before and/or along one or more collection panels of a species collection system to protect from cross winds. (Note, for simplicity, a frame is not shown in FIGS. 8A-8B.) Wind break(s) can also be used to not only break the wind but also channel the wind and induce mixing of ambient air with gas coming out of an outlet, for example in order to induce plume formation. By inducing plume formation, species (e.g., water) collection may be improved. Some examples of wind breaks are inclined louvers (e.g., as shown in FIG. 8A) that would still allow some of the wind in (e.g., at reduced velocity) or curved structures (e.g., concentric to a gas outlet) (e.g., as shown in FIG. 8B) that would introduce part of the wind stream tangentially. An additional benefit of curved wind breaks, in some embodiments, is to induce swirls after introducing wind, causing more mixing in the area between the gas outlet and the collection panels.

In some embodiments, a system comprises one or more wind breaks that are disposed above a gas outlet and below and/or along one or more collection panels. In some embodiments, the one or more wind breaks includes one or more louvers (e.g., that are angled relative to ground level, for example as shown in FIG. 8A). In some embodiments, the one or more wind breaks includes one or more curved structures (e.g., that are disposed concentrically to the gas outlet) (e.g., such that they tangentially direct wind toward a gas outlet) (e.g., as shown in FIG. 8B).

In some embodiments, collected fluid can be fed into a cold-water return (e.g., of a cooling tower), a hot water line, a basin of a cooling tower, a location at a facility, or into a water distribution system (e.g., a municipal water system). This can be done by directly feeding collected amounts of fluid down toward the relevant line, or toward a separate tank, which then feeds into the desired return, line, basin, facility or system. In some embodiments, water can be used in other parts of a plant (e.g., power plant) or sold separately.

Depending on ambient conditions and quality of collected fluid, an intermediate filtering step can be used to purify collected fluid to a certain standard (e.g., a condenser coolant water quality standard), which may depend on location and facility a fluid collection system. Filtration may be preferred if a particle injector is used to enhance condensation rate of gas in a gas stream.

Figure 7D:
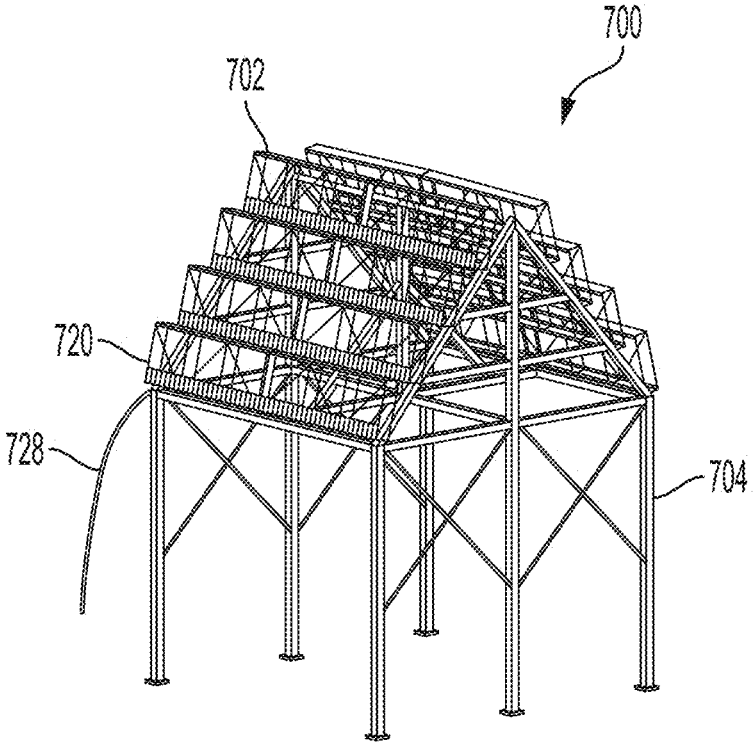
Figure 7E:
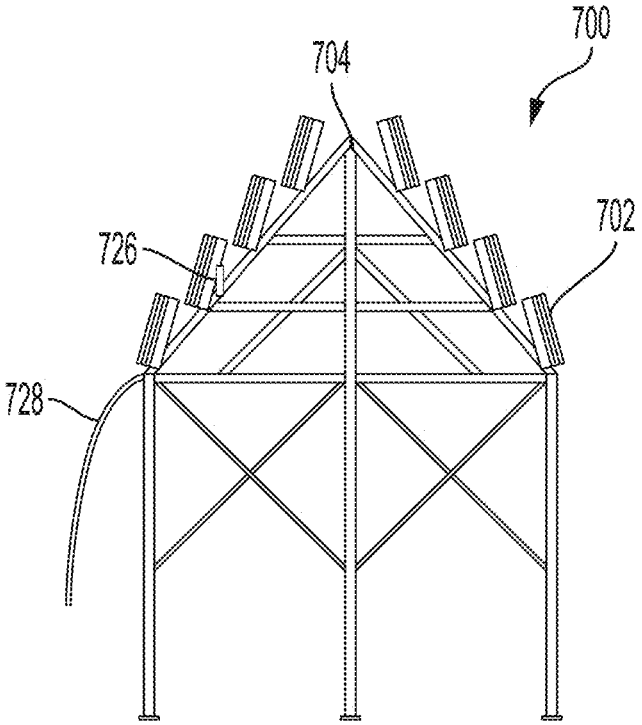

Collection panels may be moveable between an open state and a closed state. Collection panels may be moved between an open state and a closed state based on increase in ambient temperature and/or a decrease in concentration of the fluid in the gas stream. Actuators may be used to move collection panels from a closed state to an open state, or vice versa. Actuators may be, for example, pneumatic, hydraulic, or electrical actuators. Referring to FIGS. 7D and 7E, collection panels 702 can be rotated to an open state by actuating actuators 726. (One representative actuator is shown and labeled.) Collection panels 702 are rotatable between an open state and a closed state. An open state may include a vertical orientation relative to level ground. A closed state may include an angled orientation relative to level ground. For example, referring again to FIGS. 7A and 7E, for collection panels 702, the closed state includes an angled orientation relative to level ground (e.g., about 45 degrees) and the open state includes an angled orientation that is somewhat less than vertical relative to level ground.

Collection points may include one or more hinges that facilitate rotation of collection panels (e.g., between their respective open and closed states). Each collection panel may be connected to at least one corresponding hinge. In some embodiments, a single hinge is operable to rotate a plurality of collection panels. Referring to FIGS. 7A-7E, modular collection panels 702 rotate about hinges included in panel connection points 724 when moved between opened and closed states by actuators 726.

A pressure drop across collection panel(s) may be reduced (e.g., minimized) when collection panel(s) are in an open state. Collection panels in an open state may collect little to no fluid, but may provide improve gas flow. For example, moving collection panels to an open state may be useful at a cooling tower when there is no plume or when no pressure drop can be tolerated by the cooling tower, such as on a hot day when 100% cooling capacity is desired.

An open state and/or a closed state may be different for different collection panels in a fluid collection system. For example, in a system that includes a frame with a dome-shaped portion, the closed state for each of one or more collection panels may include a different angled orientation relative to level ground. In some embodiments, collection panels are individually moveable between their respective open and closed states (e.g., by individual actuation of respective actuators). Subsets of collection panels may be collectively, but separately moveable between open and closed states, for example by a common respective actuator for all collection panels in each subset. In some embodiments, collection panels are moveable to a number of discrete states between an open state and a closed state.

Certain embodiments of the present disclosure were described above. It is, however, expressly noted that the present disclosure is not limited to those embodiments, but rather the intention is that additions and modifications to what was expressly described in the present disclosure are also included within the scope of the disclosure. Moreover, it is to be understood that the features of the various embodiments described in the present disclosure were not mutually exclusive and can exist in various combinations and permutations, even if such combinations or permutations were not made express, without departing from the spirit and scope of the disclosure. Having described certain implementations of the fluid collection system, it will now become apparent to one of skill in the art that other implementations incorporating the concepts of the disclosure may be used. Therefore, the disclosure should not be limited to certain implementations, but rather should be limited only by the spirit and scope of the following claims.

What is claimed is:

1. A system for use in collecting fluid from a gas stream, the system comprising:

one or more collection panels, each of the one or more collection panels comprising an emitter electrode assembly member comprising one or more emitter electrodes, and a fluid collection member comprising one or more collection electrodes, the fluid collection member physically attached to and electrically insulated from the emitter electrode assembly member; and a frame comprising one or more panel connection points, wherein each of the one or more collection panels are attached to the frame at the one or more panel connection points and the frame is disposed near a gas outlet or near a duct for the gas stream such that the one or more collection panels are disposed after and over the gas outlet or after and over the duct, respectively, along a direction of flow of the gas stream, wherein each of the one or more collection panels is moveable while attached to the frame between an open state and a closed state.

2. The system of claim 1, wherein each of the one or more collection panels is mounted to the frame at an angle from 30 degrees to 60 degrees relative to level ground.

3. The system of claim 1, comprising one or more actuators for each of the one or more collection panels.

4. The system of claim 1, wherein the one or more connection points comprises one or more hinges.

5. The system of claim 1, wherein the frame is disposed near the gas outlet such that the one or more collection panels are disposed within 5 m of a surface of maximum fluid content of gas exiting the gas outlet.

6. The system of claim 1, wherein a position of the one or more collection panels is moveable while attached to the frame.

7. The system of claim 1, wherein the one or more collection panels are a plurality of modular collection panels that are removable from the frame.

8. The system of claim 1, wherein the frame comprises a gutter for each of the one or more collection panels, the gutter disposed such that the one or more collection panels is disposed to drain into the gutter.

9. The system of claim 8, wherein the gutter at least partially surrounds the one or more collection panels.

10. The system of claim 1, wherein the fluid collection member comprises a collection frame attached to the one or more collection electrodes, the collection frame comprising an edge disposed at least partially around a perimeter of the one or more collection electrodes, and wherein each collection panel of the one or more collection panels is disposed such that at least a portion of the edge of the collection frame of the collection panel is oriented at a bottom of the collection panel such that fluid can drain down the edge into a gutter.

11. The system of claim 1 comprising a cooling mechanism disposed along a direction of gas flow in the gas stream before the one or more collection panels.

12. The system of claim 1, comprising a humidifying mechanism disposed along a direction of gas flow in the gas stream before the one or more collection panels.

13. The system of claim 1, comprising a particle injector disposed along a direction of gas flow in the gas stream before the one or more collection panels.

14. The system of claim 1, wherein each of the one or more collection panels comprises a second emitter electrode assembly member comprising one or more second emitter electrodes, wherein the fluid collection member is physically attached to and electrically insulated from the second emitter electrode assembly member, and wherein the second emitter electrode assembly member is disposed on an opposite side of the fluid collection member from the emitter electrode assembly member such that the fluid collection member is disposed at least partially between the second emitter electrode assembly member and the emitter electrode assembly member.

15. The system of claim 1, wherein each of the one or more collection panels is operable to maintain a voltage of at least 1 kV and no more than 500 kV at the one or more emitter electrodes.

16. The panel of claim 1, wherein the one or more collection electrodes comprises a collection surface that has a low contact angle hysteresis when the one or more collection panels are connected to the frame.

17. The system of claim 1 wherein the frame is disposed near the gas outlet and the gas outlet is an air outlet of a cooling tower.

18. The system of claim 1, wherein the frame is non-planar.

19. The system of claim 18, wherein the frame comprises a dome-, triangle-, pyramid-, or arch-shaped portion at which the one or more collection panels are attached.

20. The system of claim 1, wherein the fluid collection member is physically attached to and electrically insulated from the emitter electrode assembly member by one or more electrically insulating members each comprising one or more sheds.

21. The system of claim 1, wherein the one or more collection electrodes are each a mesh collection surface disposed such that the gas stream flows through the mesh collection surface after exiting the gas outlet.

22. The system of claim 1, wherein the one or more collection electrodes are planar and are disposed non-parallel to the direction of flow of the gas stream.

23. The system of claim 1, wherein the one or more collection panels are disposed after and over the gas outlet such that ambient air can mix into the gas stream after the gas outlet and prior to collection of the fluid from the gas stream by the one or more collection panels.

24. The system of claim 1, wherein the one or more collection panels are disposed after and over the gas outlet such that the one or more collection panels are disposed to collect condensed fluid from the gas stream in a region where the fluid condenses.

25. The system of claim 1, wherein the fluid is water and the one or more collection panels are disposed after and over the gas outlet such that the one or more collection panels are disposed to collect water from a plume in the gas stream.

26. The system of claim 25, wherein the plume is a naturally occurring plume.

* * * * *